US007040302B2

(12) United States Patent
Yamaguchi et al.

(10) Patent No.: US 7,040,302 B2
(45) Date of Patent: May 9, 2006

(54) FAILURE DIAGNOSIS APPARATUS FOR EVAPORATIVE FUEL PROCESSING SYSTEM

(75) Inventors: Takashi Yamaguchi, Wako (JP); Hideyuki Oki, Wako (JP); Satoru Kubo, Wako (JP); Mahito Shikama, Wako (JP); Tomohiro Yamagami, Wako (JP); Koichi Yoshiki, Wako (JP)

(73) Assignee: Honda MOtor Co., Ltd., Tokyo (JP)

( * ) Notice: Subject to any disclaimer, the term of this patent is extended or adjusted under 35 U.S.C. 154(b) by 0 days.

(21) Appl. No.: 10/845,405

(22) Filed: May 14, 2004

(65) Prior Publication Data

US 2004/0231404 A1 Nov. 25, 2004

(30) Foreign Application Priority Data

May 21, 2003 (JP) ..... 2003-143620
Jan. 14, 2004 (JP) ..... 2004-006222

(51) Int. Cl.
*F02M 37/04* (2006.01)

(52) U.S. Cl. ..... 123/520; 123/198 D

(58) Field of Classification Search ..... 123/516, 123/518, 519, 520
See application file for complete search history.

(56) References Cited

U.S. PATENT DOCUMENTS 5,437,257 A * 8/1995 Giacomazzi et al. ..... 123/520
6,321,727 B1 * 11/2001 Reddy et al. ..... 123/520
6,688,104 B1 * 2/2004 Baeuerle et al. ..... 60/608
6,736,117 B1 * 5/2004 Isobe et al. ..... 123/520
6,789,523 B1 * 9/2004 Oki et al. ..... 123/198 D
2001/0042399 A1 * 11/2001 Dawson et al. ..... 73/49.7

FOREIGN PATENT DOCUMENTS

JP 2002-357164 12/2002

* cited by examiner

*Primary Examiner*—Thomas Moulis
(74) *Attorney, Agent, or Firm*—Arent Fox PLLC

(57) ABSTRACT

A failure diagnosis apparatus for diagnosing a failure of an evaporative fuel processing system. A pressure in the evaporative fuel processing system is detected, and a purge control valve and a vent shut valve are closed when stoppage of the engine is detected. A determination is made as to whether there is a leak in the evaporative fuel processing system based on the detected pressure during a predetermined determination period after closing of the purge control and vent shut valves.

36 Claims, 17 Drawing Sheets

(d)

FAILURE DIAGNOSIS APPARATUS FOR EVAPORATIVE FUEL PROCESSING SYSTEM

BACKGROUND OF THE INVENTION

1. Field of the Invention

The present invention relates to a failure diagnosis apparatus for diagnosing failure of an evaporative fuel processing system which temporarily stores evaporative fuel generated in a fuel tank and supplies the stored evaporative fuel to an internal combustion engine.

2. Description of the Related Art

A failure diagnosis apparatus which determines whether there is a leak in an evaporative fuel processing system after stoppage of the internal combustion engine is disclosed, for example, in Japanese Patent Laid-open No. 2002-357164. According to the conventional failure diagnosis apparatus, air is pressurized by a motor pump and introduced into the evaporative fuel processing system, and a determination is made based on a value of the load current of the motor pump as to whether there is a leak in the evaporative fuel processing system. Specifically, when a leak is determined to be present in the evaporative fuel processing system, the load current value of the motor pump decreases. Therefore, when the load current value during the pressurization is lower than a predetermined determination threshold value, a determination is made that there is a leak in the evaporative fuel processing system.

In the conventional failure diagnosis apparatus described above, use of a motor pump is necessary to perform the pressurization, which makes configuration of the apparatus complicated and increases the cost of the apparatus. Further, if there is a leak, another problem with the conventional failure diagnosis apparatus is that the evaporative fuel in the evaporative fuel processing system is emitted to the atmosphere by the pressurized air.

SUMMARY OF THE INVENTION

It is an aspect of the present invention to provide a failure diagnosis apparatus having a relatively simple configuration and which rapidly determines the presence of a leak in the evaporative fuel processing system during stoppage of the internal combustion engine.

The present invention provides a failure diagnosis apparatus for diagnosing a failure of an evaporative fuel processing system that includes a fuel tank, a canister having adsorbent for adsorbing evaporative fuel generated in the fuel tank, an air passage connected to the canister and through which the canister is in communication with the atmosphere, a first passage for connecting the canister and the fuel tank, a second passage for connecting the canister and an intake system of an internal combustion engine, a vent shut valve for opening and closing the air passage, and a purge control valve provided in the second passage. The failure diagnosis apparatus includes pressure detecting means, engine stoppage detecting means, and first determining means. The pressure detecting means detects a pressure (PTANK) in the evaporative fuel processing system. The engine stoppage detecting means detects stoppage of the engine. The first determining means closes the purge control and vent shut valves when stoppage of the engine is detected by the engine stoppage detecting means, and determines whether there is a leak in the evaporative fuel processing system based on a determination parameter (A, EDDPLSQA) corresponding to a second-order derivative value of the pressure (PTANK) detected by the pressure detecting means during a first predetermined determination period (TCHK, TMDDPTL) after closing of the purge control and vent shut valves.

With this configuration, the purge control valve and the vent shut valve are closed after stoppage of the engine, and a determination is made as to the presence of a leak in the evaporative fuel processing system. The determination of a leak is based on the determination parameter corresponding to a second-order derivative value of the pressure detected by the pressure detecting means during the predetermined determination period after closing of the purge control and vent shut valves. It has been experimentally confirmed that, if the evaporative fuel processing system is normal, the detected pressure varies substantially in a linear manner as time passes. However, if there is a leak in the evaporative fuel processing system, the rate of change in the detected pressure (i.e., the change amount of the pressure per unit time period) tends to be comparatively high at first and thereafter gradually decreases. In other words, the determination parameter corresponding to a second-order derivative value of the detected pressure maintains a value in the vicinity of "0" when the evaporative fuel processing system is normal, but indicates a negative value when there is a leak in the evaporative fuel processing system. This difference appears clearly even if the determination period is comparatively short. Accordingly, by using the determination parameter, it is possible to perform an accurate determination based on detected pressure data obtained during a comparatively short time period. Further, since no additional means, except for the pressure detecting means, is required, accurate determination is rapidly performed using a system with a simple configuration.

Preferably, the failure diagnosis apparatus, according to the present invention, further includes second determining means for determining whether there is a leak in the evaporative fuel processing system. The determination of a leak is based on a relationship between the pressure (PTANK) detected by the pressure detecting means and a staying time period (TSTY) in which the detected pressure stays at a substantially constant value during a second predetermined determination period (TMEOMAX), which is longer than the first predetermined determination period (TMDDPTL) after closing of the purge control and vent shut valves.

With this configuration, a determination is made as to the presence of a leak in the evaporative fuel processing system based on a relationship between the detected pressure and the staying time period of the detected pressure during the second predetermined determination period. Contemplating a process where the detected pressure decreases, the staying time period tends to become longer as the detected pressure decreases when there is a comparatively small hole in the evaporative fuel processing system. On the other hand, when the evaporative fuel processing system is normal, the staying time period tends to become shorter as the detected pressure decreases. Accordingly, it is possible to accurately determine whether there is a leak through a small hole in the evaporative fuel processing system based on the relationship between the detected pressure and the staying time period of the detected pressure.

Preferably, the first determining means determines that there is a leak in the evaporative fuel processing system when an absolute value of the determination parameter (A) is greater than a determination threshold value (ATH).

Preferably, the first determining means performs the determination based on the determination parameter obtained during a period in which the detected pressure rises.

Preferably, the first determining means calculates an average rate (EONVJUDX) of change in the detected pressure (PTANK) during a period in which the detected pressure changes from an initial value to a maximum value, and sets the determination threshold value (ATH) according to the average rate (EONVJUDX) of change in the detected pressure (PTANK), the initial value being substantially equal to the atmospheric pressure.

Preferably, the first determining means calculates a change rate parameter (DP) indicative of a rate of change in the detected pressure, and uses a rate (A) of change in the change rate parameter (DP) as the determination parameter.

Preferably, the first determining means statistically processes the detected values of the change rate parameter (DP) and detection timings (TMU) of the detected values to obtain a regression line indicative of a relationship between the detected value of the change rate parameter (DP) and the detection timing (TMU), and performs the determination based on an inclination (A) of the regression line.

Preferably, the second determining means performs the determination based on a relationship between the detected pressure (PTANK, CDTMPCHG) and the staying time period (TSTY, CTMSTY) when the detected pressure stays at a substantially constant value or decreases.

Preferably, the second determining means statistically processes values of the detected pressure and the staying time period to obtain a regression line indicative of a relationship between the detected pressure and the staying time period, and performs the determination based on an inclination (EODTMJUD) of the regression line.

Preferably, the second determining means determines that there is a leak in the evaporative fuel processing system when the staying time period (TDTMSTY) is longer than, or equal to, a predetermined determination time period (TDTMLK).

DETAILED DESCRIPTION OF THE PREFERRED EMBODIMENTS

Preferred embodiments of the present invention will now be described with reference to the drawings.

Figure 1:
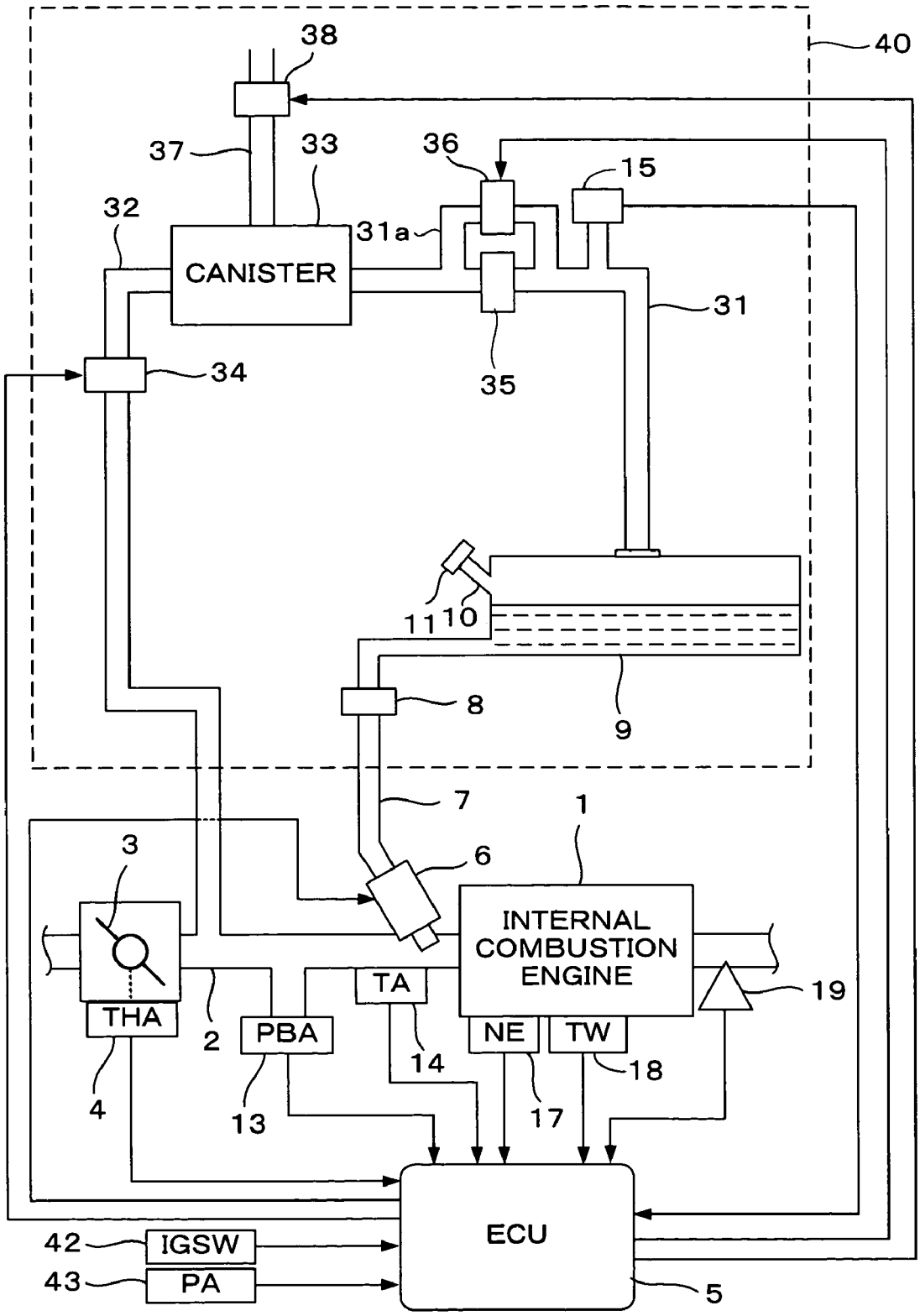
FIG. 1 is a schematic diagram of an evaporative fuel processing system and a control system of an internal combustion engine according to a first embodiment of the present invention.

FIG. 1 is a schematic diagram showing a configuration of an evaporative fuel processing system and a control system for an internal combustion engine according to a first embodiment of the present invention. Referring to FIG. 1, reference numeral 1 denotes an internal combustion engine (hereinafter referred to as "engine") having a plurality of (e.g., four) cylinders. The engine 1 is provided with an intake pipe 2 in which a throttle valve 3 is mounted. A throttle valve opening (THA) sensor 4 is connected to the throttle valve 3. The throttle valve opening sensor 4 outputs an electrical signal corresponding to an opening of the throttle valve 3 and supplies the electrical signal to an electronic control unit (hereinafter referred to as "ECU") 5.

A portion of the intake pipe 2, between the engine 1 and the throttle valve 3, is provided with a plurality of fuel injection valves 6 respectively corresponding to the plural cylinders of the engine 1 at positions slightly upstream of the respective intake valves (not shown). Each fuel injection valve 6 is connected through a fuel supply pipe 7 to a fuel tank 9. The fuel supply pipe 7 is provided with a fuel pump 8. The fuel tank 9 has a fuel filler neck 10 used during refueling. A filler cap 11 is mounted on the fuel filler neck 10.

Each fuel injection valve 6 is electrically connected to the ECU 5 and has a valve opening period controlled by a signal from the ECU 5. The intake pipe 2 is provided with an absolute intake pressure (PBA) sensor 13 and an intake air temperature (TA) sensor 14 at positions downstream of the throttle valve 3. The absolute intake pressure sensor 13 detects an absolute intake pressure PBA in the intake pipe 2. The intake air temperature sensor 14 detects an air temperature TA in the intake pipe 2.

An engine rotational speed (NE) sensor 17 for detecting an engine rotational speed is disposed near the outer periphery of a camshaft or a crankshaft (both not shown) of the engine 1. The engine rotational speed sensor 17 outputs a pulse (TDC signal pulse) at a predetermined crank angle per 180-degree rotation of the crankshaft of the engine 1. An engine coolant temperature sensor 18 is provided for detecting a coolant temperature TW of the engine 1 and an oxygen concentration sensor (hereinafter referred to as "LAF sensor") 19 is provided for detecting an oxygen concentration in exhaust gases from the engine 1. Detection signals from the sensors 13 to 15 and 17 to 19 are supplied to the ECU 5. The LAF sensor 19 functions as a wide-region air-fuel ratio sensor, which outputs a signal substantially proportional to an oxygen concentration in exhaust gases (i.e., proportional to an air-fuel ratio of an air-fuel mixture supplied to the engine 1).

An ignition switch 42 and an atmospheric pressure sensor 43 for detecting the atmospheric pressure are also connected to the ECU 5. A switching signal from the ignition switch 42 and a detection signal from the atmospheric pressure sensor 43 are supplied to the ECU 5.

The fuel tank 9 is connected, through a charging passage 31, to a canister 33. The canister 33 is connected, through a purging passage 32, to the intake pipe 2 at a position downstream of the throttle valve 3.

The charging passage 31 is provided with a two-way valve 35. The two-way valve 35 includes a positive-pressure valve and a negative-pressure valve. The positive-pressure valve opens when the pressure in the fuel tank 9 is greater than atmospheric pressure by a first predetermined pressure (e.g., 2.7 kPa (20 mmHg)) or more. The negative-pressure valve opens when the pressure in the fuel tank 9 is less than the pressure in the canister 33 by a second predetermined pressure or more.

The charging passage 31 is branched to form a bypass passage 31*a* that bypasses the two-way valve 35. The bypass passage 31*a* is provided with a bypass valve (i.e., on-off valve) 36. The bypass valve 36 is a solenoid valve that is normally closed, and is opened and closed during execution of a failure diagnosis to hereinafter be described. The operation of the bypass valve 36 is controlled by the ECU 5.

The charging passage 31 is further provided with a pressure sensor 15 at a position between the two-way valve 35 and the fuel tank 9. A detection signal output from the pressure sensor 15 is supplied to the ECU 5. The output PTANK of the pressure sensor 15 takes a value equal to the pressure in the fuel tank 9 in a steady state when the pressures in the canister 33 and the fuel tank 9 are stable. The output PTANK of the pressure sensor 15 takes a value that is different from the actual pressure in the fuel tank 9 when the pressure in the canister 33 or the fuel tank 9 is changing. The output of the pressure sensor 15 will hereinafter be referred to as "tank pressure PTANK".

The canister 33 contains active carbon for adsorbing the evaporative fuel in the fuel tank 9. A vent passage 37 is connected to the canister 33 to facilitate communication of the canister 33 with the atmosphere therethrough.

The vent passage 37 is provided with a vent shut valve (on-off valve) 38. The vent shut valve 38 is a solenoid valve, operation of which is controlled by the ECU 5 in such a manner that the vent shut valve 38 is open during refueling or when the evaporative fuel adsorbed in the canister 33 is purged to the intake pipe 2. Further, the vent shut valve 38 is opened and closed during execution of the failure diagnosis to hereinafter be described. The vent shut valve 38 is a normally open valve which remains open when no drive signal is supplied thereto.

The purging passage 32, connected between the canister 33 and the intake pipe 2, is provided with a purge control valve 34. The purge control valve 34 is a solenoid valve capable of continuously controlling the flow rate by changing the on-off duty ratio of a control signal (by changing an opening degree of the purge control valve). The operation of the purge control valve 34 is controlled by the ECU 5.

The fuel tank 9, the charging passage 31, the bypass passage 31*a*, the canister 33, the purging passage 32, the two-way valve 35, the bypass valve 36, the purge control valve 34, the vent passage 37, and the vent shut valve 38 form an evaporative fuel processing system 40.

In this embodiment, even after the ignition switch 42 is turned off, the ECU 5, the bypass valve 36, and the vent shut valve 38 are kept powered during the execution period of the failure diagnosis to hereinafter be described. The purge control valve 34 is powered off to maintain a closed condition when the ignition switch 42 is turned off.

When a large amount of evaporative fuel is generated upon refueling of the fuel tank 9, the canister 33 stores the evaporative fuel. In a predetermined operating condition of the engine 1, the duty control of the purge control valve 34 is performed to supply a suitable amount of evaporative fuel from the canister 33 to the intake pipe 2.

The ECU 5 includes an input circuit, a central processing unit (hereinafter referred to as "CPU"), a memory circuit, and an output circuit. The input circuit has various functions, including shaping the waveform of input signals from various sensors, correcting a voltage level to a predetermined level, and converting analog signal values into digital signal values. The memory circuit stores operation programs to be executed by the CPU, results of the calculations performed by the CPU, and the like. The output circuit supplies driving signals to the fuel injection valve 6, purge control valve 34, bypass valve 36, and vent shut valve 38.

The CPU in the ECU 5 performs control of a fuel amount to be supplied to the engine 1, duty control of the purge control valve, and other necessary controls according to output signals of the various sensors, such as the engine rotational speed sensor 17, the absolute intake pressure sensor 13, and the engine water temperature sensor 18. The CPU in the ECU 5 executes a failure diagnosis process of the evaporative fuel processing system 40 described below.

Figure 2A:
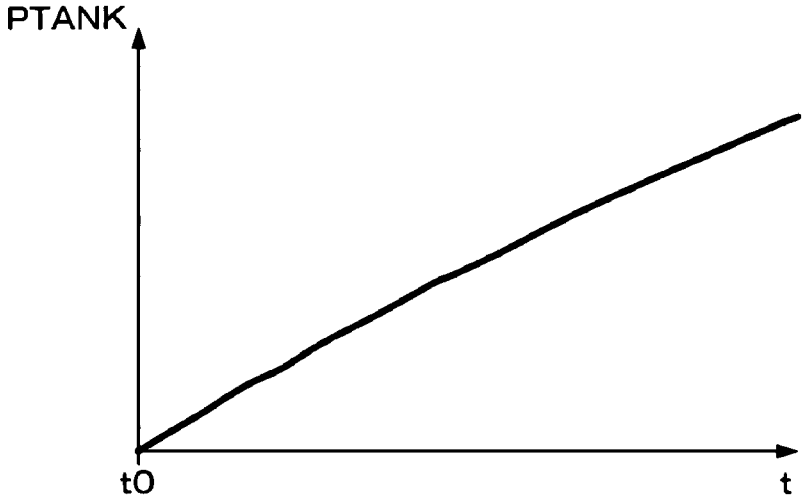
FIGS. 2A and 2B are time charts illustrating changes in the tank pressure (PTANK) when a failure diagnosis of the evaporative fuel processing system is performed.
Figure 2B:
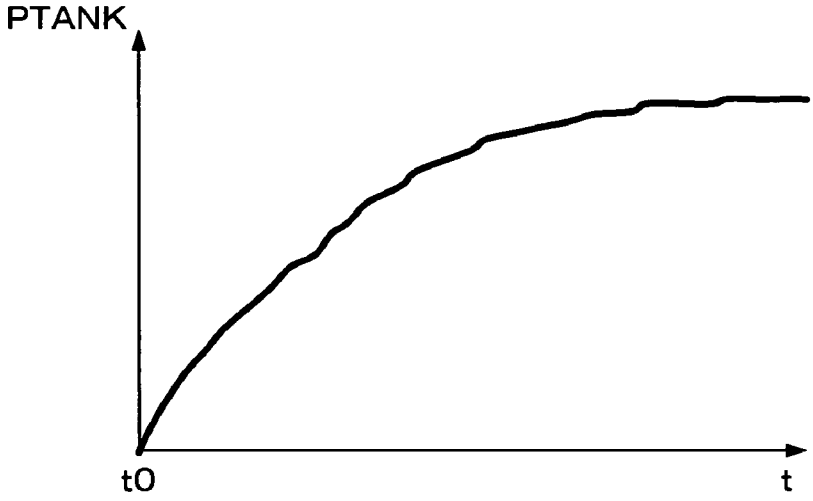

FIGS. 2A and 2B are time charts showing changes in the tank pressure PTANK for illustrating a failure diagnosis method for the evaporative fuel processing system of the present embodiment. Specifically, FIGS. 2A and 2B illustrate changes in the tank pressure PTANK after time t0 at which the vent shut valve 38 is closed. Before closing of the vent shut valve 38, an open-to-atmosphere process for opening the vent shut valve 38 and the bypass valve 36 is executed for a predetermined time period after stoppage of the engine 1. FIG. 2A corresponds to the case where the evaporative fuel processing system 40 is normal. FIG. 2B corresponds to the case where there is a leak in the evaporative fuel processing system 40. As can be seen from FIGS. 2A and 2B, when the evaporative fuel processing system 40 is normal, the tank pressure PTANK substantially increases in a linear manner, while when there is a leak in the evaporative fuel processing system 40, the tank pressure PTANK first increases with a comparatively high rate of change (inclination), and thereafter the rate of change in the tank pressure PTANK tends to gradually decrease. Accordingly, by detecting this difference, a determination can be made as to whether there is a leak in the evaporative fuel processing system 40. Specifically, if calculating a determination parameter which corresponds to a second-order derivative value of the tank pressure PTANK, the determination parameter takes a value substantially equal to "0" when the evaporative fuel processing system 40 is normal. The determination parameter will take a negative value when there is a leak in the evaporative fuel processing system 40. In the present embodiment, the absolute value of the determination parameter is compared with a determination threshold value, and a determination is made that there is a leak in the evaporative fuel processing system 40 when the absolute value of the determination parameter is higher than the determination threshold value.

Figure 3A:
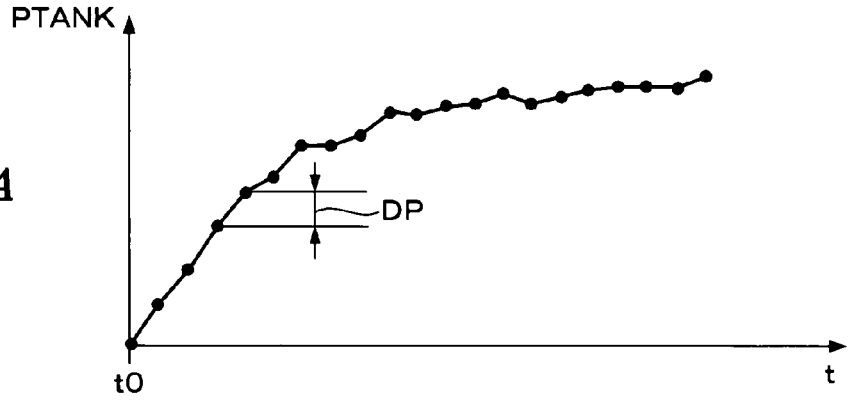
FIG. 3A is a time chart illustrating actually measured data of the tank pressure (PTANK) and FIG. 3B is a diagram showing a regression line (L1) calculated based on the actually measured data.

FIG. 3A illustrates an example of actually measured data of the tank pressure PTANK sampled at constant time intervals. When expressing the detected value of the tank pressure PTANK sampled at constant time intervals as "PTANK(k)", the change amount DP is calculated by the following expression (1).

$$DP=PTANK(k)-PTANK(k-1) \quad (1)$$

Figure 3B:
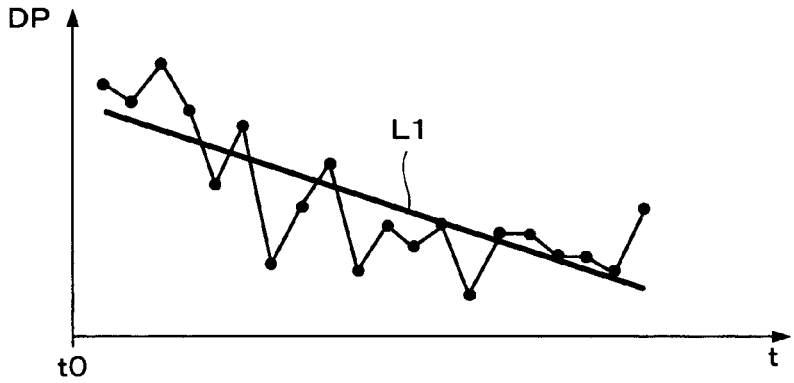

FIG. 3B is a time chart illustrating a transition of the change amount DP. FIG. 3B indicates an overall tendency that the change amount DP gradually decreases, although the individual data values appear to be dispersed. Therefore, in the present embodiment, a regression line L1 indicating a transition of the change amount DP is determined by the least squares method, and an inclination A of the regression line L1 is used as the determination parameter.

Figure 4:
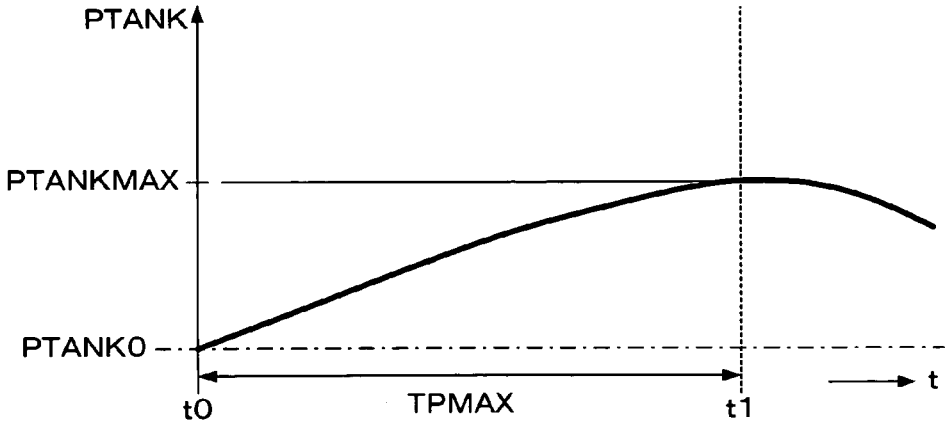
FIG. 4 is a time chart illustrating detection of a maximum pressure (PTANKMAX) within a time period in which the failure diagnosis is performed.

However, it has been experimentally confirmed that, when the amount of evaporative fuel generated in the fuel tank is great and the rate of the pressure change after closing the vent shut valve 38 is high, the change amount DP tends to gradually decrease, even if the evaporative fuel processing system 40 is normal. Therefore, in the present embodiment, as shown in FIG. 4, a maximum value PTANKMAX of the tank pressure PTANK after time t0, at which the vent shut valve 38 is closed, is detected, and an average change rate EONVJUDX within the period from time t0 to time t1, at which the tank pressure PTANK becomes the maximum, is calculated in accordance with the following expression (2). Further, a determination threshold value ATH is set according to the average change rate EONVJUDX.

$$EONVJUDX=(PTANKMAX-PTANK0)/TPMAX \quad (2)$$

Figure 5:
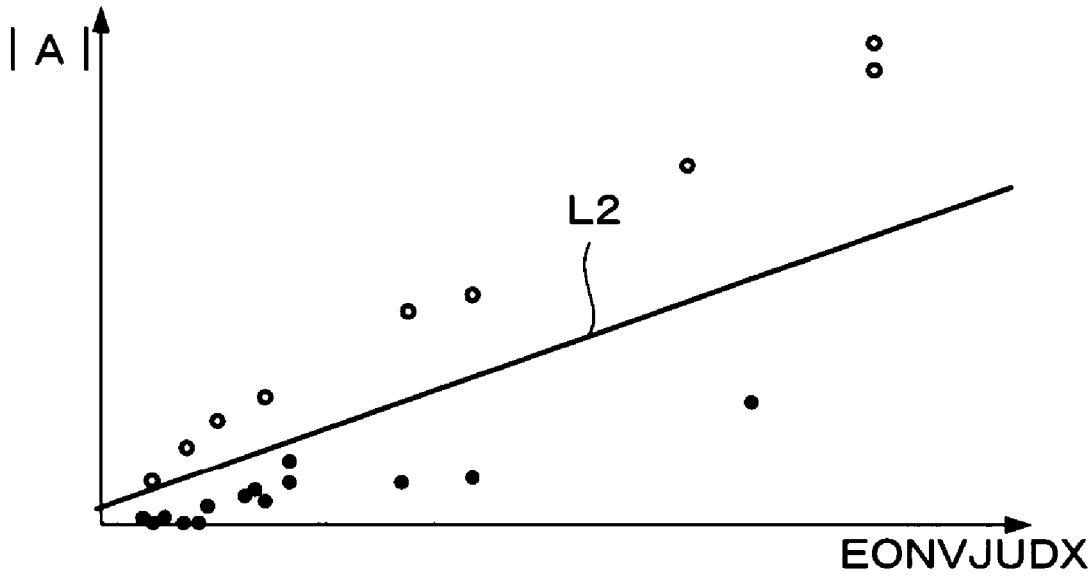
FIG. 5 is a diagram illustrating distribution of absolute values of inclinations (A) of the regression line.

FIG. 5 illustrates actually measured data plotted on a coordinate plane defined by the horizontal axis, which indicates the average change rate EONVJUDX, and the vertical axis, which indicates the absolute value of the inclination A. In FIG. 5, black round marks correspond to actually measured data of a normal evaporative fuel processing system and white, or open, round marks correspond to actually measured data of an evaporative fuel processing system in which there is a leak. As seen from FIG. 5, the coordinate plane can be divided into a normal region and a leak region by a straight line L2. Accordingly, if the absolute value of the inclination A on the straight line L2 corresponding to the average change rate EONVJUDX is used as the determination threshold value ATH, accurate leak determination can be performed.

Figure 6:
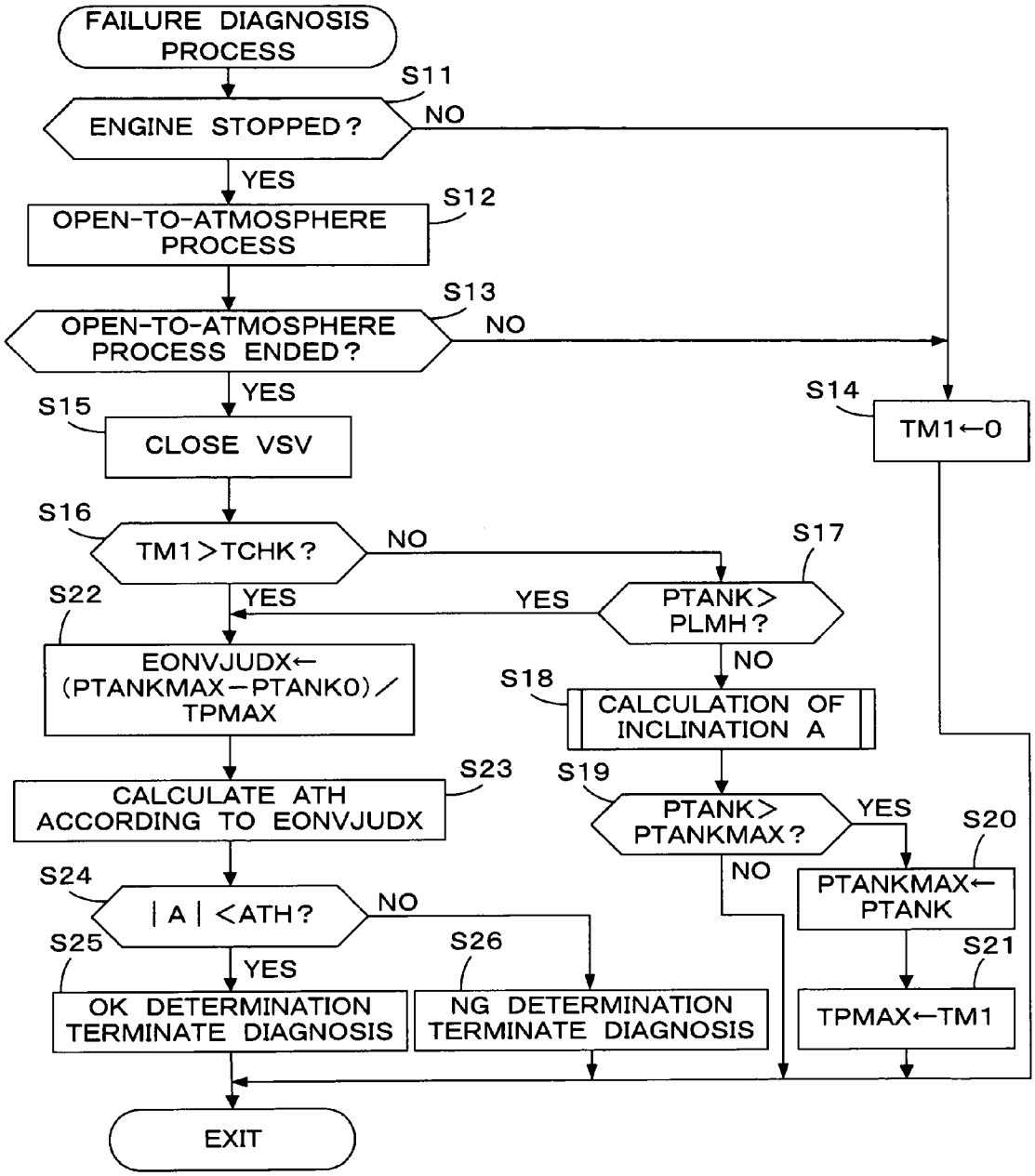
FIG. 6 is a flowchart of a failure diagnosis process of the evaporative fuel processing system.

FIG. 6 is a flowchart of a portion of the failure diagnosis process of the evaporative fuel processing system 40. The failure diagnosis method described above is applied to this failure diagnosis process. The failure diagnosis process is executed by the CPU of the ECU 5 at predetermined time intervals (for example, 80 milliseconds).

In step S11, it is determined whether the engine 1 is stopped, that is, whether the ignition switch is off. If the engine 1 is operating, then a value of an upcount timer TM1 is set to "0" (step S14). Thereafter, the process ends.

When the engine 1 thereafter stops, the process advances from step S11 to step S12, in which an open-to-atmosphere process is executed. Specifically, the vent shut valve 38 and the bypass valve 36 are opened to make the evaporative fuel processing system 40 open to the atmosphere. The open-to-atmosphere process is executed for a predetermined open-to-atmosphere time period (for example, 90 seconds).

In step S13, it is determined whether the open-to-atmosphere process has ended. If the open-to-atmosphere process has not ended, then the process advances to step S14 described above. When the open-to-atmosphere process has ended, the tank pressure PTANK is substantially equal to the atmospheric air pressure PATM. Then, the tank pressure PTANK is stored as an initial pressure PTANK0.

Figure 7:
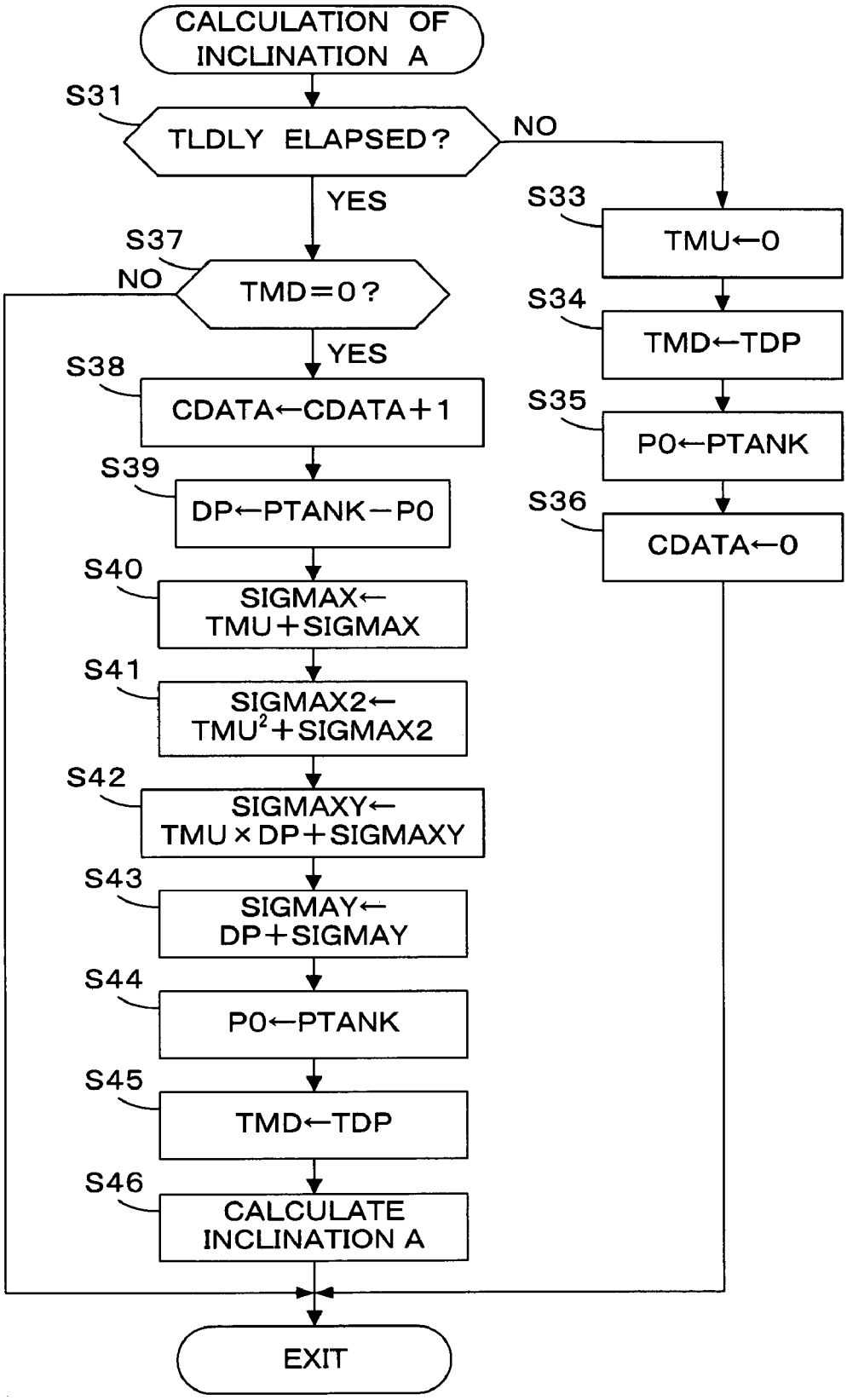
FIG. 7 is a flowchart illustrating a calculation process of the inclination A executed in the process of FIG. 6.

After the open-to-atmosphere process has ended, the process advances to step S15, in which the vent shut valve 38 is closed. Then, it is determined whether the value of the timer TM1 exceeds a predetermined determination time period TCHK (300 seconds) (step S16). Since the answer is initially negative (NO), it is determined whether the tank pressure PTANK is higher than a predetermined upper limit pressure PLMH (for example, a pressure which is higher by 2.7 kPa (20 mmHg) than the initial pressure PTANK0) (step S17). Since the answer is initially negative (NO), the process advances to step S18, in which an inclination A calculation process shown in FIG. 7 is executed. By executing the inclination A calculation process, the inclination A of the regression line L1 described above is calculated.

Next, in step S19, it is determined whether the tank pressure PTANK is higher than the maximum pressure PTANKMAX. Since the maximum pressure PTANKMAX is initialized to a very small value (for example, "0"), the answer is initially affirmative (YES). Accordingly, the tank pressure PTANK is stored as the maximum pressure PTANKMAX (step S20). Further, the present value of the timer TM1 is stored as a maximum pressure detection time period TPMAX (step S21).

If the tank pressure PTANK is higher than the maximum pressure PTANKMAX in the following execution of this process, then the process advances from step S19 to step S20. If the tank pressure PTANK is equal to or lower than the maximum pressure PTANKMAX, then the process immediately ends. By executing steps S19 to S21, the maximum pressure PTANKMAX, which is a maximum value of the tank pressure PTANK during execution of the failure diagnosis, and the maximum pressure detection time period TPMAX, which is a time period required for the tank pressure PTANK to increase from the initial pressure PTANK0 to the maximum value PTANKMAX, are obtained.

When the tank pressure PTANK is higher than the predetermined upper limit pressure PLMH in step S17, or when the value of the upcount timer TM1 is greater than the predetermined determination time period TCHK in step S16, the process advances to step S22, in which the average change rate EONVJUDX is calculated in accordance with the expression (2) described above.

In step S23, the determination threshold value ATH is calculated according to the average change rate EONVJUDX. Specifically, a table corresponding to the straight line L2 shown in FIG. 5 is retrieved to calculate the determination threshold value ATH. Alternatively, the determination threshold value ATH is calculated using the equation corresponding to the straight line L2.

In step S24, it is determined whether the absolute value of the inclination A is less than the determination threshold value ATH. If the answer is affirmative (YES), then it is determined that the evaporative fuel processing system 40 is normal, and the failure diagnosis is terminated (step S25). On the other hand, if |A| is greater than or equal to ATH, then it is determined that there is a leak in the evaporative fuel processing system 40, and the failure diagnosis is terminated (step S26).

FIG. 7 is a flowchart of the inclination A calculation process executed in step S18 of FIG. 6.

In step S31, it is determined whether a predetermined time period TLDLY (for example, 1 second) has elapsed from the time the vent shut valve 38 is closed. Until the predetermined time period TLDLY elapses, the process advances to step S33, in which an upcount timer TMU is set to "0". Next, a downcount timer TMD is set to a predetermined time period TDP (for example, 1 second) and started (step S34). Then, an initial pressure P0 for calculating the pressure change amount DP is set to the present tank pressure PTANK (step S35), and a counter CDATA for counting the number of data is set to "0" (step S36). Thereafter, the process ends.

After the predetermined time period TLDLY has elapsed, the process advances from step S31 to step S37, in which it is determined whether the value of the downcount timer TMD is "0". Since TMD is greater than "0" initially, the process immediately ends. When TMD becomes "0", the process advances to step S38, in which the counter CDATA is incremented by "1". Next, the initial pressure P0 is subtracted from the present tank pressure PTANK to calculate the change amount DP (PTANK−P0) (step S39).

In step S40, an integrated value SIGMAX of the value of the upcount timer TMU is calculated in accordance with the following expression (3).

$$SIGMAX = TMU + SIGMAX \tag{3}$$

where SIGMAX on the right side is the preceding calculated value.

In step S41, the following expression (4) is used to calculate an integrated value SIGMAX2, which is an integrated value of a squared value of the value of the upcount timer TMU.

$$SIGMAX2 = TMU^2 + SIGMAX2 \tag{4}$$

where SIGMAX2 on the right side is the preceding calculated value.

In step S42, the following expression (5) is used to calculate an integrated value SIGMAXY of the product of the value of the upcount timer TMU and the change amount DP.

$$SIMGMAXY = TMU \times DP + SIGMAXY \tag{5}$$

where SIGMAXY on the right side is the preceding calculated value.

In step S43, the following expression (6) is used to calculate an integrated value SIGMAY of the pressure change amount DP.

$$SIGMAY = DP + SIGMAY \tag{6}$$

where SIGMAY on the right side is the preceding calculated value.

In step S44, the initial pressure P0 is set to the present tank pressure PTANK. Next, the downcount timer TMD is set to the predetermined time period TDP and started (step S45). In step S46, the integrated values SIGMAX, SIGMAX2, SIGMAXY and SIGMAY, calculated in steps S40 to S43, and the value of the counter CDATA are applied to the following expression (7) to calculate the inclination A of the regression line. The expression (7) is well known as an expression for calculating the inclination of a regression line with the least squares method.

$$A = \frac{SIGMAXY - (SIGMAX \times SIGMAY) / CDATA}{SIGMAX2 - SIGMAX^2 / CDATA} \tag{7}$$

By means of steps S37 and S45, steps S38 to S46 are executed at intervals corresponding to the predetermined time period TDP, thereby calculating the inclination A of the regression line based on the detected values of the change amount DP.

As described above, in the present embodiment, a determination is made as to the presence of a leak in the evaporative fuel processing system based on the inclination of a variation characteristic of the pressure change amount DP (a determination parameter which corresponds to a second-order derivative value with respect to time) of the tank pressure PTANK. Therefore, accurate failure diagnosis is rapidly performed with a simple configuration. Further, by using a statistical method of determining a regression line based on detected values of the pressure change amount DP, the influence of dispersion of the detected value is reduced and accuracy of the diagnosis is improved.

In the present embodiment, the pressure sensor 15 corresponds to the pressure detecting means, and the ignition switch 42 corresponds to the engine stoppage detecting means. Further, the ECU 5 corresponds to the first determining means. More specifically, the process shown in FIGS. 6 and 7 corresponds to the first determining means.

In the second embodiment of the present invention, the configuration of the evaporative fuel processing system 40 and the control system for the internal combustion engine is similar to that in the first embodiment shown in FIG. 1. The points that differ from the first embodiment will be described below.

Figure 8:
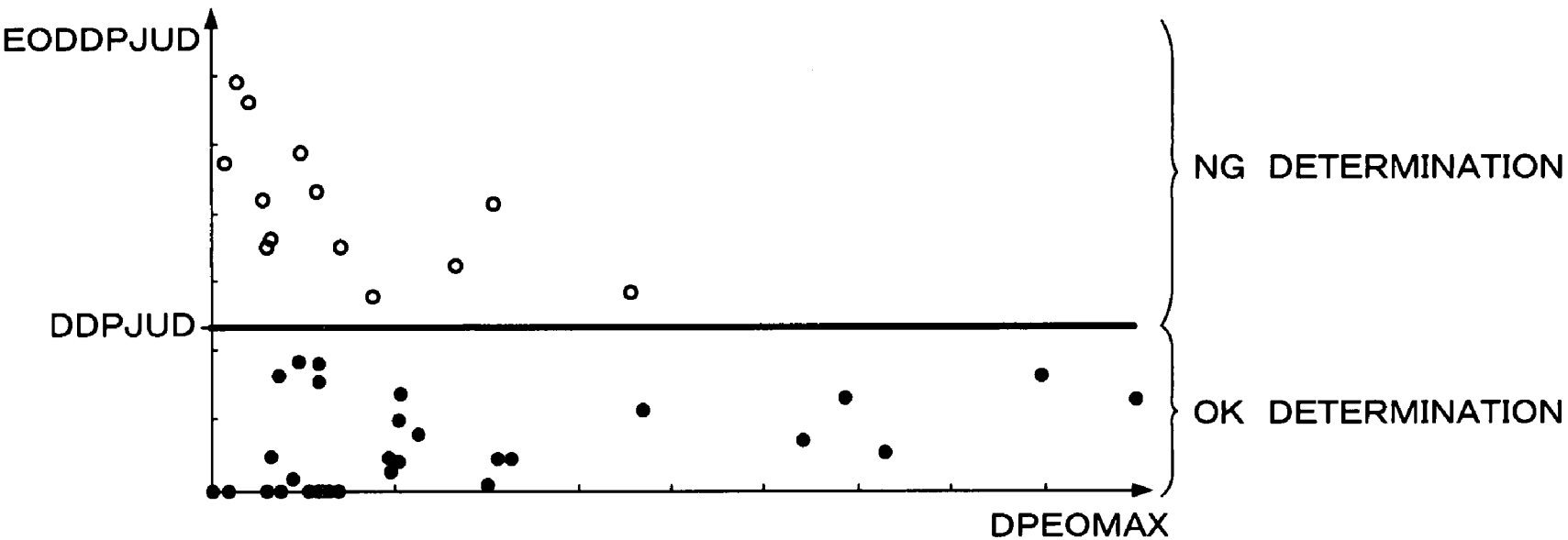
FIG. 8 is a diagram illustrating a first determination method according to a second embodiment of the present invention.

FIG. 8 is a graph illustrating a first determination method in the present or second embodiment. The first determination method is substantially the same as the determination method described above in the first embodiment. However, a determination parameter EODDPJUD, to be used for the final determination, is calculated in accordance with the following expression (8).

$$EODDPJUD = EDDPLSQA / DPEOMAX \tag{8}$$

where EDDPLSQA is an inclination parameter corresponding to the inclination A in the first embodiment. The inclination parameter EDDPLSQA actually takes a negative value when there is a leak in the evaporative fuel processing system 40, while the inclination parameter EDDPLSQA takes a value close to "0" when there is no leak in the evaporative fuel processing system 40. In the present embodiment, a value obtained by reversing the sign (plus/minus) of the inclination A in the first embodiment is used as the inclination parameter EDDPLSQA. Further, DPEOMAX in the expression (8) is a maximum pressure within the determination time period. The maximum pressure DPEOMAX corresponds to the maximum pressure PTANKMAX in the first embodiment.

FIG. 8 shows data plotted on a coordinate plane defined by the vertical axis, which indicates the determination parameter EODDPJUD and the horizontal axis, which indicates the maximum pressure DPEOMAX. In FIG. 8, black round marks correspond to the case where the evaporative fuel processing system 40 is normal and white, or open, round marks correspond to the case where there is a leak in the evaporative fuel processing system 40. As seen from FIG. 8, by appropriately setting a determination threshold value DDPJUD, the case where there is a leak in the evaporative fuel processing system 40 is accurately determined.

According to the first determination method, when there is a comparatively small hole in the evaporative fuel processing system 40 and the change rate of the tank pressure PTANK is very low, the leak through the small hole cannot be detected. Therefore, in the present embodiment, a second determination method is used to determine whether there is a leak through a small hole (hereinafter referred to as "small hole leak") in the evaporative fuel processing system 40.

Figure 9A:
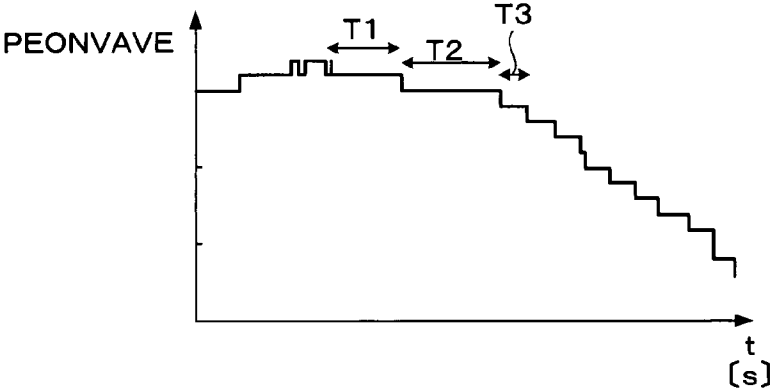
FIGS. 9A to 9D are diagrams illustrating a second determination method in the second embodiment.
Figure 9B:
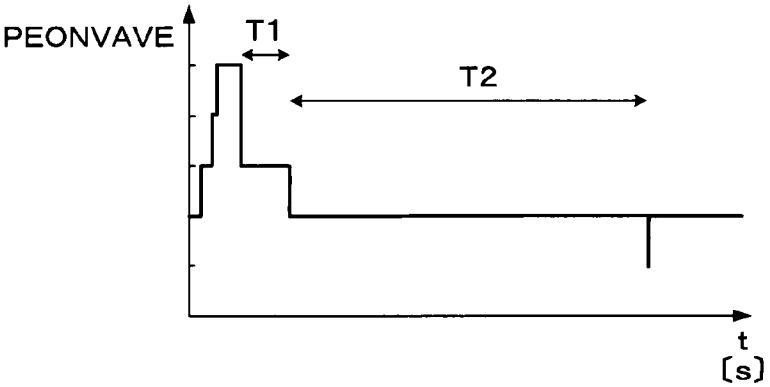
Figure 9C:
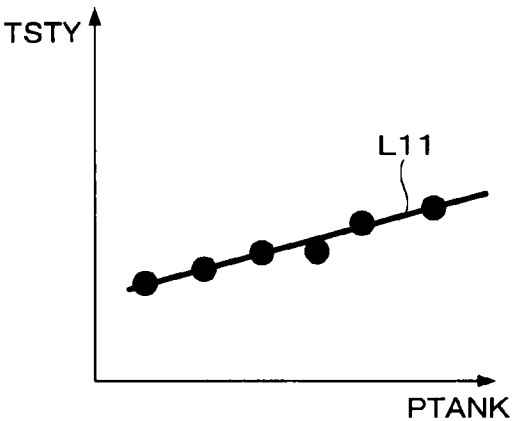
Figure 9D:
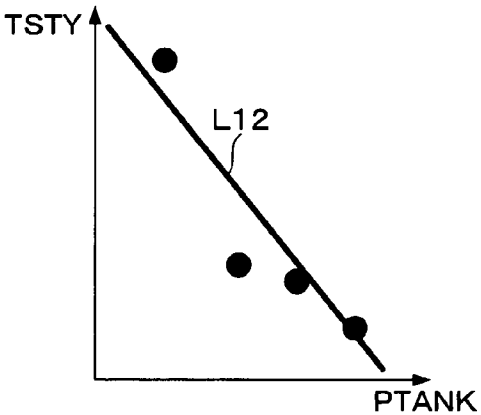

FIGS. 9A to 9D are graphs illustrating the second determination method. FIG. 9A shows changes in the tank pressure PTANK when the evaporative fuel processing system 40 is normal, while FIG. 9B shows changes in the tank pressure PTANK when there is a small hole leak in the evaporative fuel processing system 40. If a time period during which the detected pressure does not vary is defined as a "staying time period TSTY", time periods T1, T2 and T3 correspond to the staying time period TSTY. By plotting the relationship between the staying time period TSTY and the tank pressure PTANK, correlation characteristics shown in FIGS. 9C and 9D are obtained. FIG. 9C corresponds to the case where the evaporative fuel processing system 40 is normal and FIG. 9D corresponds to the case where there is a small hole leak in the evaporative fuel processing system 40. By noting the inclinations of regression lines L11 and L12 shown in FIGS. 9C and 9D, it is apparent that the inclination AL11 of the regression line L11 takes a comparatively small positive value, while the inclination AL12 of the regression line L12 takes a negative value having a large absolute value. Therefore, in the present embodiment, a small hole leak is determined based on the inclination of a regression line indicative of the correlation characteristic between the tank pressure PTANK and the staying time period TSTY. This method is hereinafter referred to as a "second determination method".

It is to be noted that, in the present embodiment, not the tank pressure PTANK itself but a tank pressure parameter PEONVAVE, obtained by averaging (low-pass filtering) the tank pressure PTANK, is used for the leak determination.

Figure 10:
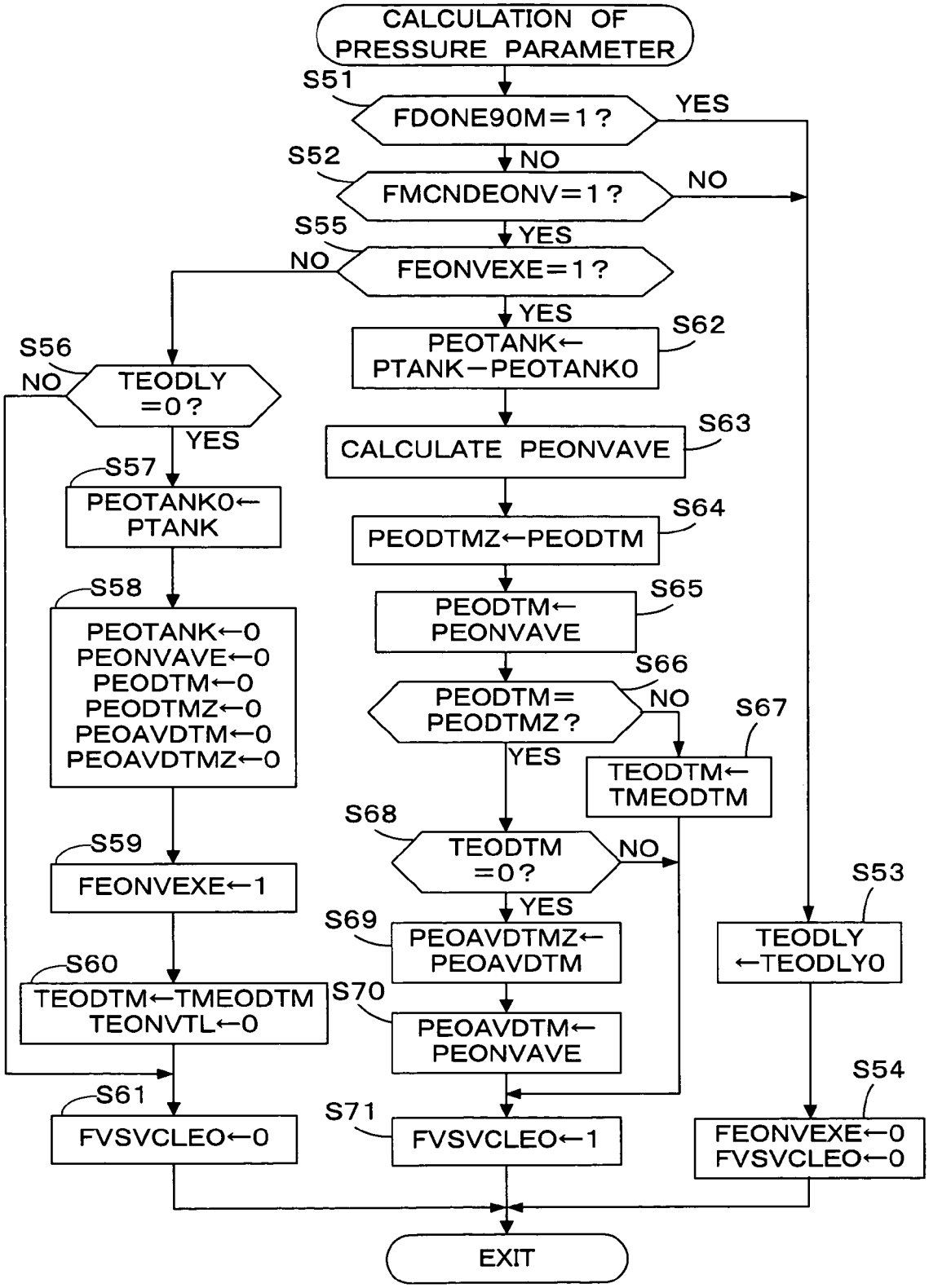
FIG. 10 is a flowchart illustrating a process of calculating a pressure parameter to be used in the leak determination.

FIG. 10 is a flowchart of a process for calculating pressure parameters, that is, a tank pressure parameter PEONVAVE and a staying tank pressure parameter PEOAVDTM which corresponds to a value when the tank pressure parameter PEONVAVE is staying. This process is executed by the CPU in the ECU 5 at predetermined time intervals (for example, 80 milliseconds).

In step S51, it is determined whether a determination completion flag FDONE90M is "1". If the answer is negative (NO), that is, if the leak determination is not completed, then it is determined whether an execution condition flag FMCNDEONV is "1" (step S52). The execution condition flag FMCNDEONV is set to "1" when an execution condition of the leak determination is satisfied in an execution condition determination process (not shown). It is to be noted that, in the present embodiment, when the execution condition flag FMCNDEONV is set to "1", the open-to-atmosphere process is terminated.

When FDONE90M is equal to "1", i.e., the leak determination is completed, or when FMCNDEONV is equal to "0", i.e., the leak determination execution condition is not satisfied, a downcount timer TEODLY is set to a predetermined time period TEODLY0 (for example, 10 seconds) and started (step S53). In step S54, an execution flag FEONVEXE and a VSV closing request flag FVSVCLEO are set to "0", and the process ends. The execution flag FEONVEXE is set to "1" in step S59 described below. The VSV closing request flag FVSVCLEO is set to "1" when the vent shut valve 38 is to be closed (refer to step S71).

If the execution condition flag FMCNDEONV is "1", indicating that the execution condition is satisfied in step S52, then it is determined whether the execution flag FEONVEXE is "1" (step S55). Since the answer to step S55 is initially negative (NO), the process advances to step S56, in which it is determined whether the value of the timer TEODLY started in step S53 is "0". Since the answer to step S56 is initially negative (NO), the VSV closing request flag FVSVCLEO is set to "0" (step S61), and the process ends.

If TEODLY becomes "0" in step S56, then the process advances to step S57, in which the present tank pressure PTANK is stored as a start pressure PEOTANK0. In step S58, a modified tank pressure PEOTANK, a tank pressure parameter PEONVAVE, a comparison parameter PEODTM, a preceding value PEODTMZ of the comparison parameter PEODTM, a staying tank pressure parameter PEOAVDTM, and a preceding value PEOAVDTMZ of the staying tank pressure parameter PEOAVDTM are all set to "0". The modified tank pressure PEOTANK is calculated by subtracting the start pressure PEOTANK0 from the tank pressure PTANK (refer to step S62). Further, the comparison parameter PEODTM and the preceding value PEODTMZ thereof are used to determine the staying condition of the tank pressure parameter PEONVAVE in step S66 described below.

In step S59, the execution flag FEONVEXE is set to "1". In step S60, a downcount timer TEODTM is set to a predetermined time period TMEODTM (for example 5 seconds) and started, and an upcount timer TEONVTL is set to "0" and started. Thereafter, the process advances to step S61 described above.

After the execution flag FEONVEXE is set to "1" in step S59, the answer to step S55 becomes affirmative (YES). Consequently, the process advances to step S62, in which the start pressure PEOTANK0 is subtracted from the tank pressure PTANK to calculate the modified tank pressure PEOTANK. In step S63, the tank pressure parameter PEONVAVE is calculated in accordance with the following expression (9).

$$PEONVAVE = CPTAVE \times PEONVAVE + (1 - CPTAVE) \times PEOTANK \quad (9)$$

where CPTAVE is an averaging coefficient set to a value between "0" and "1", and PEONVAVE on the right side is the preceding calculated value.

In step 564, the preceding value PEODTMZ of the comparison parameter is set to the present value PEODTM. In step S65, the present value PEODTM of the comparison parameter is set to the tank pressure parameter PEONVAVE. In step S66, it is determined whether the preceding value and the present value of the comparison parameter are equal to each other. If the answer to step S66 is negative (NO), i.e., the tank pressure parameter PEONVAVE is changing, then the downcount timer TEODTM is set to the predetermined time period TMEODTM and started (step S67). Next, the process advances to step S71, in which the VSV closing request flag FVSVC LEO is set to "1". Thereafter, the process ends. When the VSV closing request flag FVSVCLEO is set to "1", the vent shut valve 38 is closed.

If the answer to step S66 is affirmative (YES), i.e., the tank pressure parameter PEONVAVE is staying, then it is determined whether the value of the timer TEODTM is "0" (step S68). Since the answer to this step is initially negative (NO), the process immediately advances to step S71. If the answer to step S68 changes to affirmative (YES), then the preceding value PEOAVDTMZ of the staying tank pressure parameter is set to the present value PEOAVDTM (step S69), and the present value PEOAVDTM is set to the tank pressure parameter PEONVAVE (step S70). Thereafter, the process advances to step S71 described above.

According to the process of FIG. 10, when the leak determination execution condition is satisfied, initialization of the various parameters is performed (steps S57 to S60), and the vent shut valve 38 is closed (step S71). During execution of the leak determination, calculation of the tank pressure parameter PEONVAVE, the staying tank pressure parameter PEOAVDTM, and the preceding value PEOAVTMZ of the staying tank pressure parameter PEOAVDTM is executed. The parameters are referred to in the leak determination process (shown in FIGS. 11, 12, 14, 17 and 18) described below.

Figure 11:
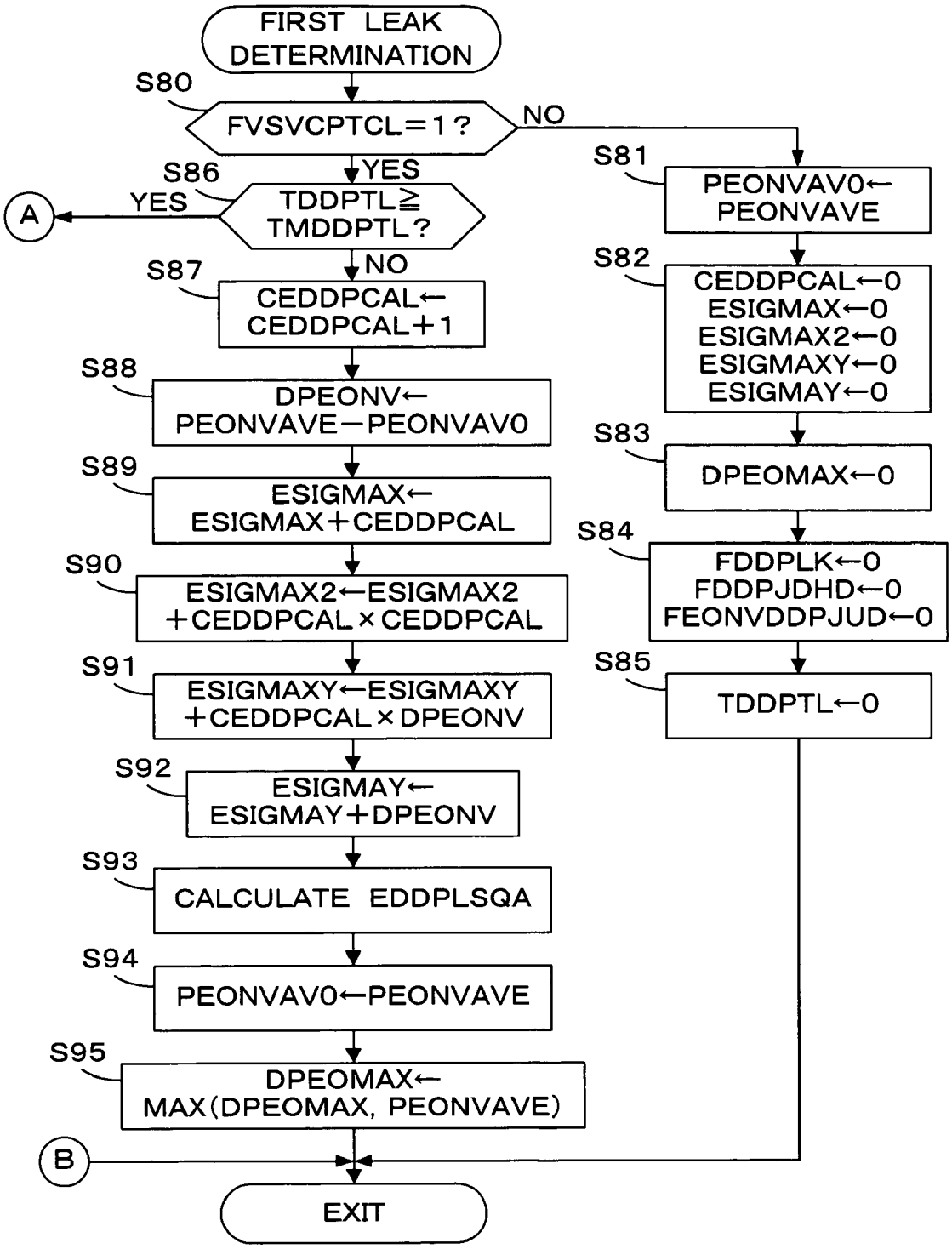
FIGS. 11 and 12 are flowcharts illustrating a process of the leak determination (first leak determination) based on the first determination method.
Figure 12:
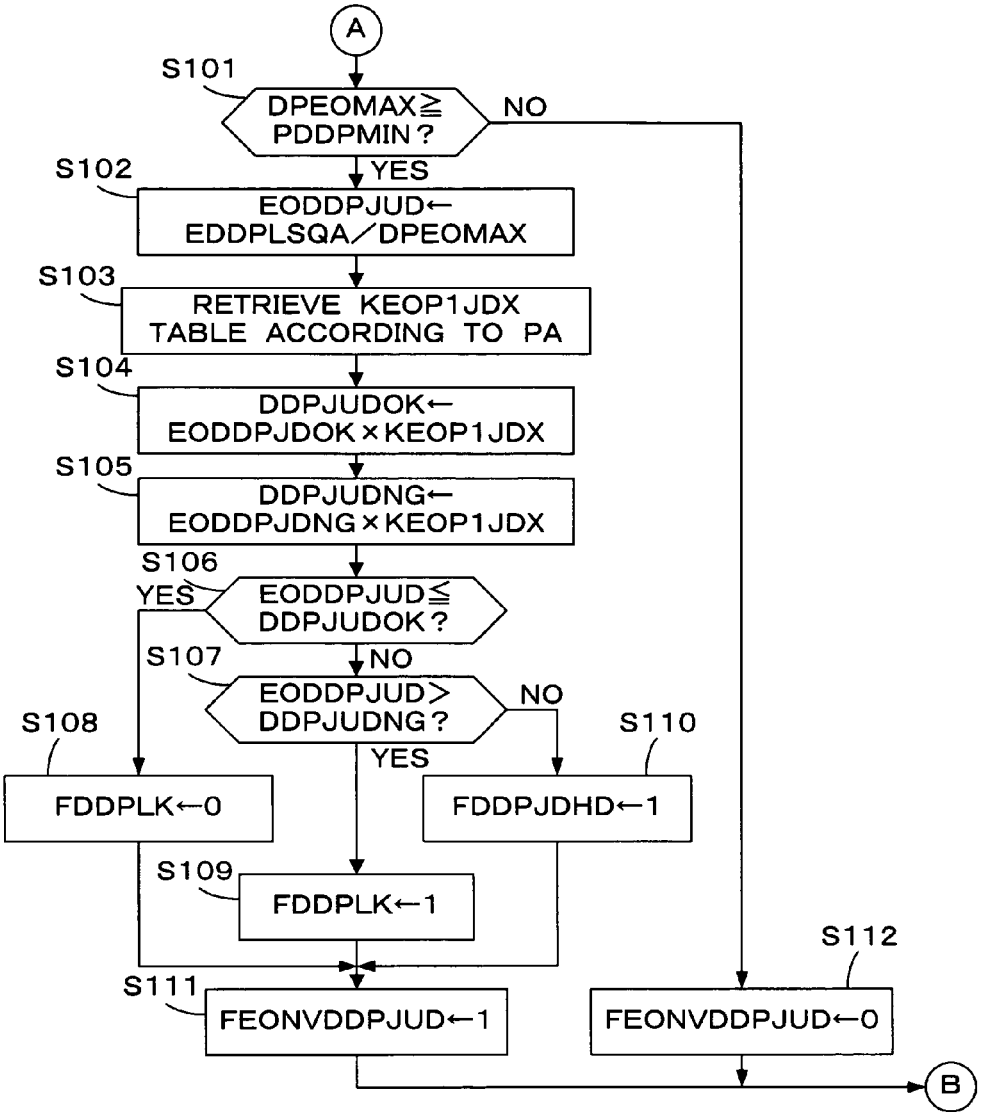

FIGS. 11 and 12 are flowcharts of a process for performing a leak determination (first leak determination) based on the first determination method. This process is executed at predetermined time intervals (for example, 1 second) by the CPU in the ECU 5.

In step S80, it is determined whether a VSV closing flag FVSVCPTCL is "1". If the VSV closing flag FVSVCPTCL is "0", i.e., the vent shut valve 38 is open, then an initial pressure PEONVAV0 is set to the present tank pressure parameter PEONVAVE (step S81). In step S82, initialization of parameters to be used for calculation of the first inclination parameter EDDPLSQA is performed. Specifically, a time parameter CEDDPCAL which increases proportionally to the elapsed time, an integrated value ESIGMAX of the time parameter CEDDPCAL, an integrated value ESIGMAX2 of a value obtained by squaring the time parameter CEDDPCAL, an integrated value ESIGMAXY of the product of the time parameter CEDDPCAL and a pressure change amount DPEONV, and an integrated value ESIGMAY of the pressure change amount DPEONV are all set to "0".

In step S83, the maximum pressure DPEOMAX is set to "0". The maximum pressure DPEOMAX is a maximum value within the determination period calculated in step S95 (DPEOMAX corresponds to the maximum pressure PTANKMAX in the first embodiment). In step S84, a first leak determination flag FDDPLK, a withholding flag FDDPJDHD, and a first leak determination end flag FEONVDDPJUD are all set to "0". The first leak determination flag FDDPLK, the withholding flag FDDPJDHD, and the first leak determination end flag FEONVDDPJUD are set to "1" respectively in steps S109, S110 and S111 of FIG. 12. In step S85, the value of an upcount timer TDDPTL is set to "0". Thereafter, the process ends.

If FVSVPTCL is equal to "1" in step S80, i.e., the vent shut valve 38 is closed, then the process advances to step S86, in which it is determined whether the value of the timer TDDPTL is equal to or greater than a predetermined time period TMDDPTL (for example, 300 seconds). Since the answer to this step is initially negative (NO), steps S87 to S95 are executed to calculate the first inclination parameter EDDPLSQA and the maximum pressure DPEOMAX.

In step S87, the time parameter CEDDPCAL is incremented by "1". In step S88, the initial pressure PEONVAV0 is subtracted from the tank pressure parameter PEONVAVE to calculate a pressure change amount DPEONV.

In step S89, the integrated value ESIGMAX of the time parameter CEDDPCAL is calculated by the following expression (10).

$$ESIGMAX = ESIGMAX + CEDDPCAL \tag{10}$$

where ESIGMAX on the right side is the preceding calculated value.

In step S90, the integrated value ESIGMAX2 of a value obtained by squaring the time parameter CEDDPCAL is calculated by the following expression (11).

$$ESIGMAX2 = ESIGMAX2 + CEDDPCAL \times CEDDPCAL \tag{11}$$

where ESIGMAX2 on the right side is the preceding calculated value.

In step S91, the integrated value ESIGMAXY of the product of the time parameter CEDDPCAL and the pressure change amount DPEONV is calculated by the following expression (12).

$$ESIGMAXY = ESIGMAXY + CEDDPCAL \times DPEONV \tag{12}$$

where ESIGMAXY on the right side is the preceding calculated value.

In step S92, the integrated value ESIGMAY of the pressure change amount DPEONV is calculated by the following expression (13).

$$ESIGMAY = ESIGMAY + DPEONV \tag{13}$$

where ESIGMAY on the right side is the preceding calculated value.

In step S93, the time parameter CEDDPCAL and the integrated values ESIGMAX, ESIGMAX2, ESIGMAXY and ESIGMAY, calculated in steps S87 and S89 to S92, are applied to the following expression (14) to calculate the first inclination parameter EDDPLSQA.

$$EDDPLSQA = \frac{ESIGMAXY - (ESIGMAX \times ESIGMAY)/CEDDPCAL}{ESIGMAX2 - ESIGMAX^2/CEDDPCAL} \tag{14}$$

In step S94, the initial pressure PEONVAV0 is set to the present tank pressure parameter PEONVAVE. In step S95, the greater one of the maximum pressure DPEOMAX and the tank pressure parameter PEONVAVE is selected and the maximum pressure DPEOMAX is calculated by the following expression (15).

$$DPEOMAX = MAX(DPEOMAX, PEONVAVE) \tag{15}$$

If the value of the timer TDDPTL reaches the predetermined time period TMDDPTL in step S86, then the process advances to step S101 (FIG. 12), in which it is determined whether the maximum pressure DPEOMAX is equal to or greater than a determination permission pressure PDDPMIN (for example, 67 Pa (0.5 mmHg)). If the answer to this step is negative (NO), indicating that the rise in the tank pressure PTANK is insufficient, then the first leak determination end flag FEONVDDPJUD is set to "0" (step S112), since an accurate determination cannot be expected. Thereafter, the process ends.

If DPEOMAX is greater than or equal to PDDPMIN in step S101, then the determination parameter EODDPJUD is calculated by the expression (8) described above (step S102).

Figure 13:
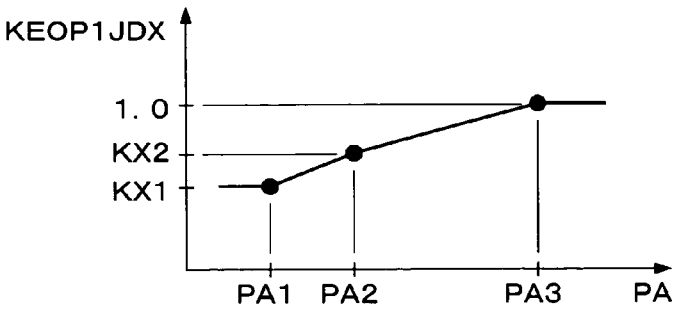
FIG. 13 is a diagram illustrating a table used in the process of FIG. 12.

In step S103, a KEOP1JDX table illustrated in FIG. 13 is retrieved according to the atmospheric pressure PA to calculate a correction coefficient KEOP1JDX. The KEOP1JDX table is set such that the correction coefficient KEOP1JDX decreases as the atmospheric pressure PA decreases. PA1, PA2 and PA3 shown in FIG. 13 are set respectively to 77 kPa (580 mmHg), 84 kPa (630 mmHg), and 99 kPa (740 mmHg), for example. KX1 and KX2 are set respectively to 0.75 and 0.84, for example.

In steps S104 and S105, the correction coefficient KEOP1JDX is applied to the following expressions (16) and (17) to calculate an OK determination threshold value DDPJUDOK and an NG determination threshold value DDPJUDNG.

$$DDPJUDOK=EODDPJDOK\times KEOP1JDX \quad (16)$$

$$DDPJUDNG=EODDPJDNG\times KEOP1JDX \quad (17)$$

where EODDPJDOK and EODDPJDNG are a predetermined OK determination threshold value and a predetermined NG determination threshold value, respectively. The predetermined OK determination threshold value EODDPJDOK is set to a value less than the predetermined NG determination threshold value EODDPJDNG.

In step S106, it is determined whether the determination parameter EODDPJUD is equal to or less than the OK determination threshold value DDPJUDOK. If the answer to this step is affirmative (YES), then it is determined that the evaporative fuel processing system 40 is normal, and the first leak determination flag FDDPLK is set to "0" (step S108).

If EODDPJUD is greater than DDPJUDOK in step S106, then it is determined whether the determination parameter EODDPJUD is greater than the NG determination threshold value DDPJUDNG (step S107). If the answer to this step is affirmative (YES), then it is determined that there is a leak in the evaporative fuel processing system 40 and the first leak determination flag FDDPLK is set to "1" (step S109). On the other hand, if the answer to step S107 is negative (NO), that is, if EODDPJUD is greater than DDPJUDOK and less than or equal to DDPJUDNG, then the leak determination is decided to be withheld, and a withholding flag FDDPJDHD is set to "1" (step S110).

In step S111, the first leak determination end flag FEONVDDPJUD is set to "1". Thereafter the process ends.

According to the process shown in FIGS. 11 and 12, the first inclination parameter EDDPLSQA, which corresponds to a second-order derivative value of the tank pressure parameter PEONVAVE with respect to time, is calculated, and the first inclination parameter EDDPLSQA is divided by the maximum pressure DPEOMAX to calculate a determination parameter EODDJUD. When the determination parameter EODDJUD is equal to or less than the OK determination threshold value DDPJUDOK, it is determined that the evaporative fuel processing system 40 is normal, while when the determination parameter EODDJUD is greater than the NG determination threshold value DDPJUDNG, it is determined that there is a leak in the evaporative fuel processing system 40. When the determination parameter EODDJUD is greater than the OK determination threshold value DDPJUDOK and lower than or equal to the NG determination threshold value DDPJUDNG, the decision of withholding the determination is made.

Figure 14:
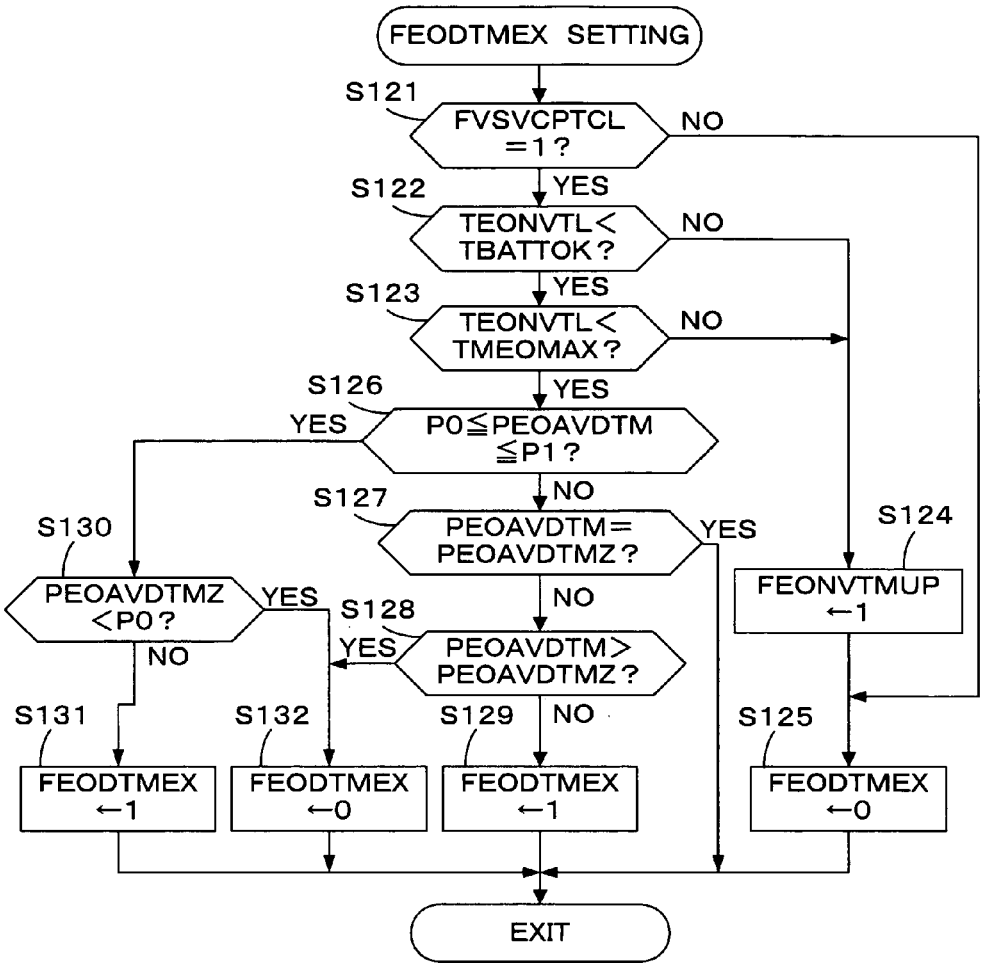
FIG. 14 is a flowchart of a process of determining an execution condition of a leak determination (second leak determination) based on the second determination method.

FIG. 14 is a flowchart of a process for determining an execution condition of a leak determination (hereinafter referred to as "second leak determination") with the second determination method described above, to set a second leak determination condition flag FEODTMEX. This process is executed at predetermined time intervals (for example, 1 second).

In step S121, it is determined whether the VSV closing flag FVSVCPTCL is "1". If FVSVCPTCL is equal to "0", indicating that the open-to-atmosphere process is being executed, then the second leak determination condition flag FEODTMEX is set to "0" (step S125).

If the vent shut valve 38 is closed, then the process advances from step S121 to step S122, in which it is determined whether the value of an upcount timer TEONVTL, for measuring the time period from the time the vent shut valve 38 is closed, is less than a battery permission time period TBATTOK being set in accordance with a battery charge/discharge condition. If TEONVTL is less than TBATTOK, then it is further determined whether the value of the upcount timer TEONVTL is less than a maximum execution time period TMEOMAX (for example, 2,400 seconds) (step S123). If the answer to step S122 or S123 is negative (NO), then an interruption flag FEONVTMUP is set to "1" (step S124), and the process advances to step S125.

If TEONVTL is less than TMEOMAX in step S123, then it is determined whether the staying tank pressure parameter PEOAVDTM is equal to or higher than a first predetermined pressure P0 and equal to or lower than a second predetermined pressure P1 (step S126). The first predetermined pressure P0 is set to a value which is, for example, equal to the atmospheric pressure, while the second predetermined pressure P1 is set to a value which is a little higher than the first predetermined pressure P0, for example, to a value higher by 0.133 kPa (1 mmHg) than the first predetermined pressure P0.

If the answer to step S126 is affirmative (YES) and the staying tank pressure parameter PEOAVDTM is in the vicinity of the atmospheric pressure, then it is determined that the preceding value PEOAVDTMZ of the staying tank pressure parameter is lower than the first predetermined pressure P0 (step S130). If PEOAVDTMZ is less than P0, indicating that the staying tank pressure parameter PEOAVDTM is increasing, then the second leak determination condition flag FEODTMEX is set to "0" (step S132). On the other hand, if PEOAVDTMZ is greater than or equal to P0, indicating that the staying tank pressure parameter PEOAVDTM is staying or decreasing, then the second leak determination condition flag FEODTMEX is set to "1" (step S131).

If the answer to step S126 is negative (NO), that is, PEOAVDTM is less than P0 or PEOAVDTM is greater than P1, then it is determined whether the present value PEOAVDTM and the preceding value PEOAVDTMZ of the staying tank pressure parameter are equal to each other (step S127). If the answer to this step is affirmative (YES), indicating that the staying tank pressure parameter PEOAVDTM is not changing, then the process immediately ends.

If the answer to step S127 is negative (NO), indicating that the staying tank pressure parameter PEOAVDTM has changed, then it is determined whether the present value PEOAMDTM of the staying tank pressure parameter is higher than the preceding value PEOAVDTMZ (step S128). If the answer to this step is affirmative (YES), indicating that the staying tank pressure parameter PEOAVDTM has increased, then the process advances to step S132 described above. If the answer to step S128 is negative (NO), indicating that the staying tank pressure parameter PEOAVDTM has decreased, then the second leak determination condition flag FEODTMEX is set to "1" (step S129).

Figure 15A:
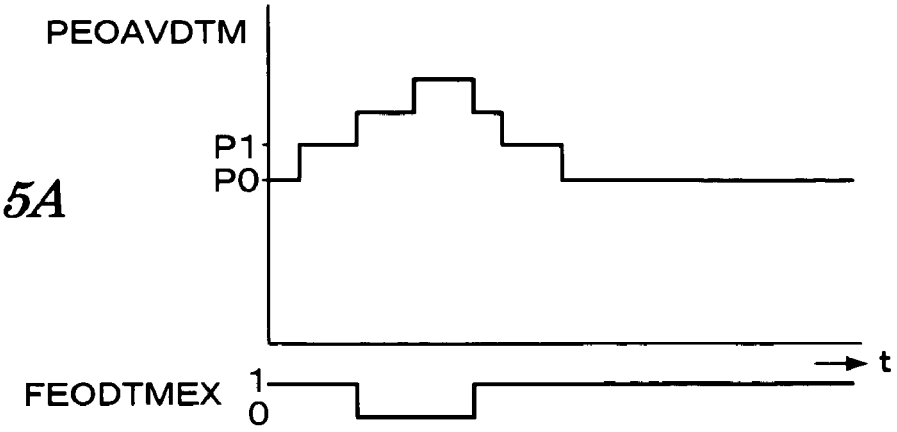
FIGS. 15A to 15C are diagrams illustrating setting of a second leak determination condition flag FEODTMEX according to the process of FIG. 14.
Figure 15B:
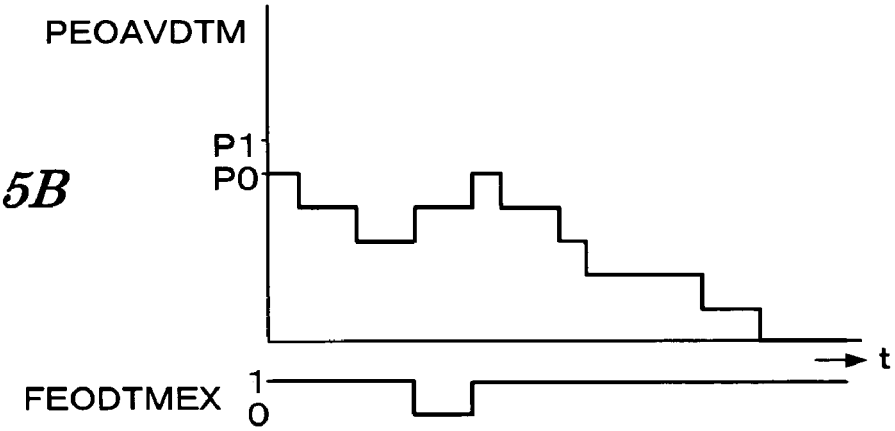
Figure 15C:
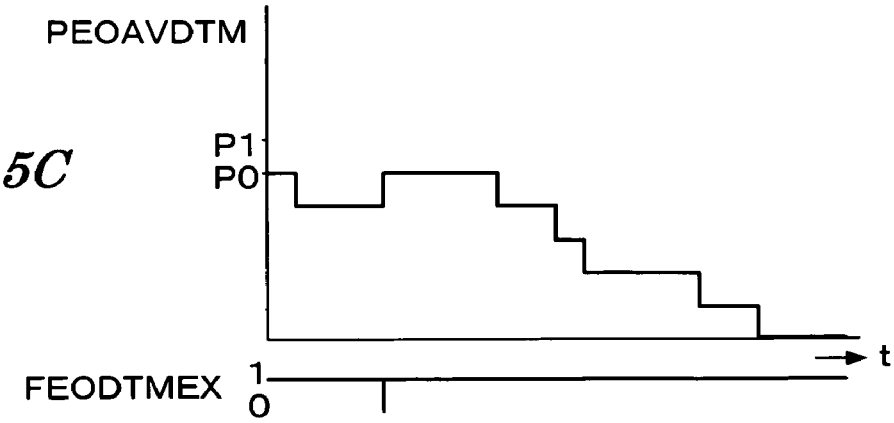
Figure 16A:
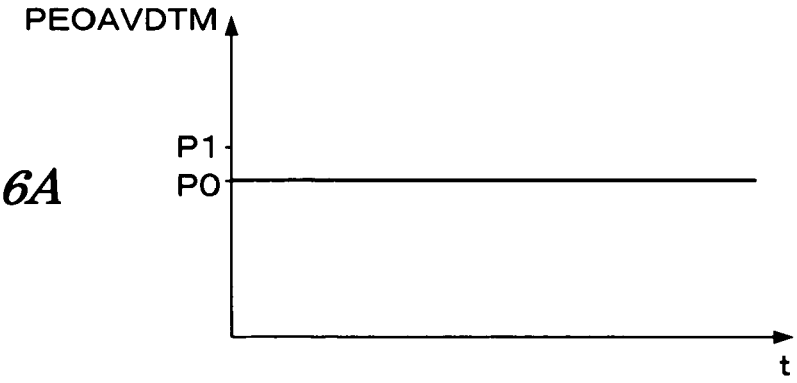
FIGS. 16A to 16D are diagrams illustrating setting of the second leak determination condition flag FEODTMEX according to the process of FIG. 14.
Figure 16B:
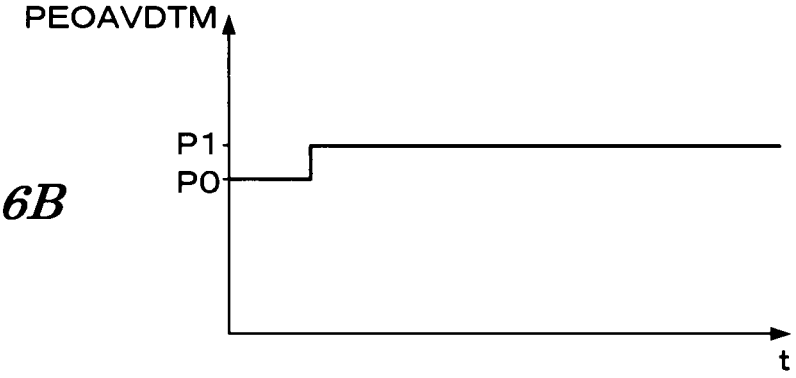
Figure 16C:
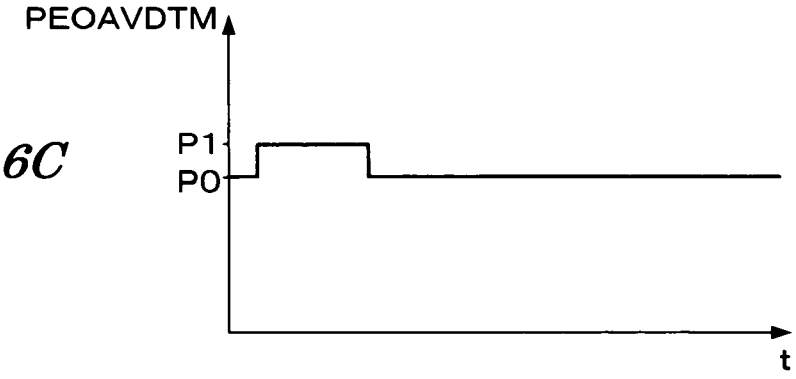
Figure 16D:
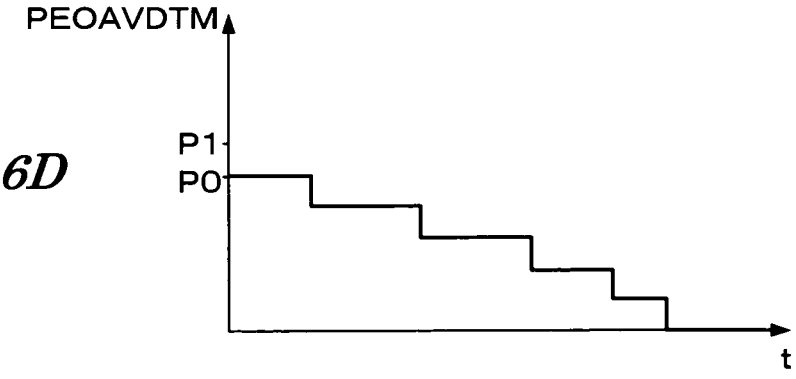

FIGS. 15A to 15C and 16A to 16D are graphs illustrating setting of the second leak determination condition flag FEODTMEX by the process of FIG. 14. Basically, as shown in FIGS. 15A to 15C, when the staying tank pressure parameter PEOAVDTM is increasing, the second leak determination condition flag FEODTMEX is set to "0", and when the staying tank pressure parameter PEOAVDTM is decreasing, the second leak determination condition flag FEODTMEX is set to "1". Further, as shown in FIGS. 16A to 16C, when the staying tank pressure parameter PEOAVDTM stays in the vicinity of atmospheric pressure (i.e., within the range from P0 to P1), the second leak determination condition flag FEODTMEX is always set to "1". Further, as shown in FIG. 16D, also when the staying tank pressure parameter PEOAVDTM decreases from the beginning, the second leak determination condition flag FEODTMEX is always set to "1". In other words, the second leak determination is performed when the staying tank pressure parameter PEOAVDTM stays in the vicinity of the atmospheric pressure, or is decreasing. It is to be noted that, in the example illustrated in FIGS. 16A to 16D, the second leak determination condition flag FEODTMEX is not shown since the second leak determination condition flag FEODTMEX is always set to "1".

Figure 17:
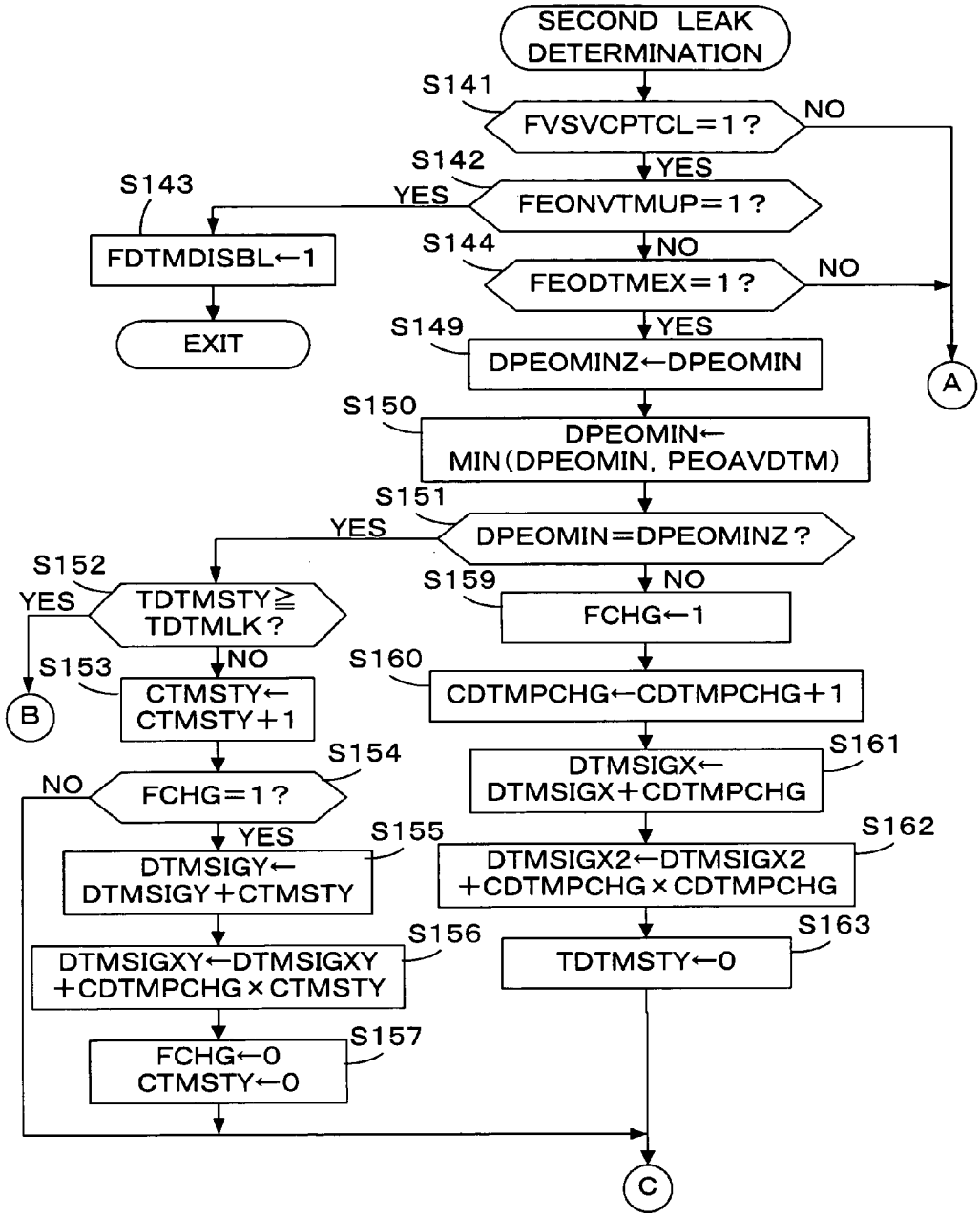
FIGS. 17 and 18 are flowcharts illustrating a process of the second leak determination.
Figure 18:
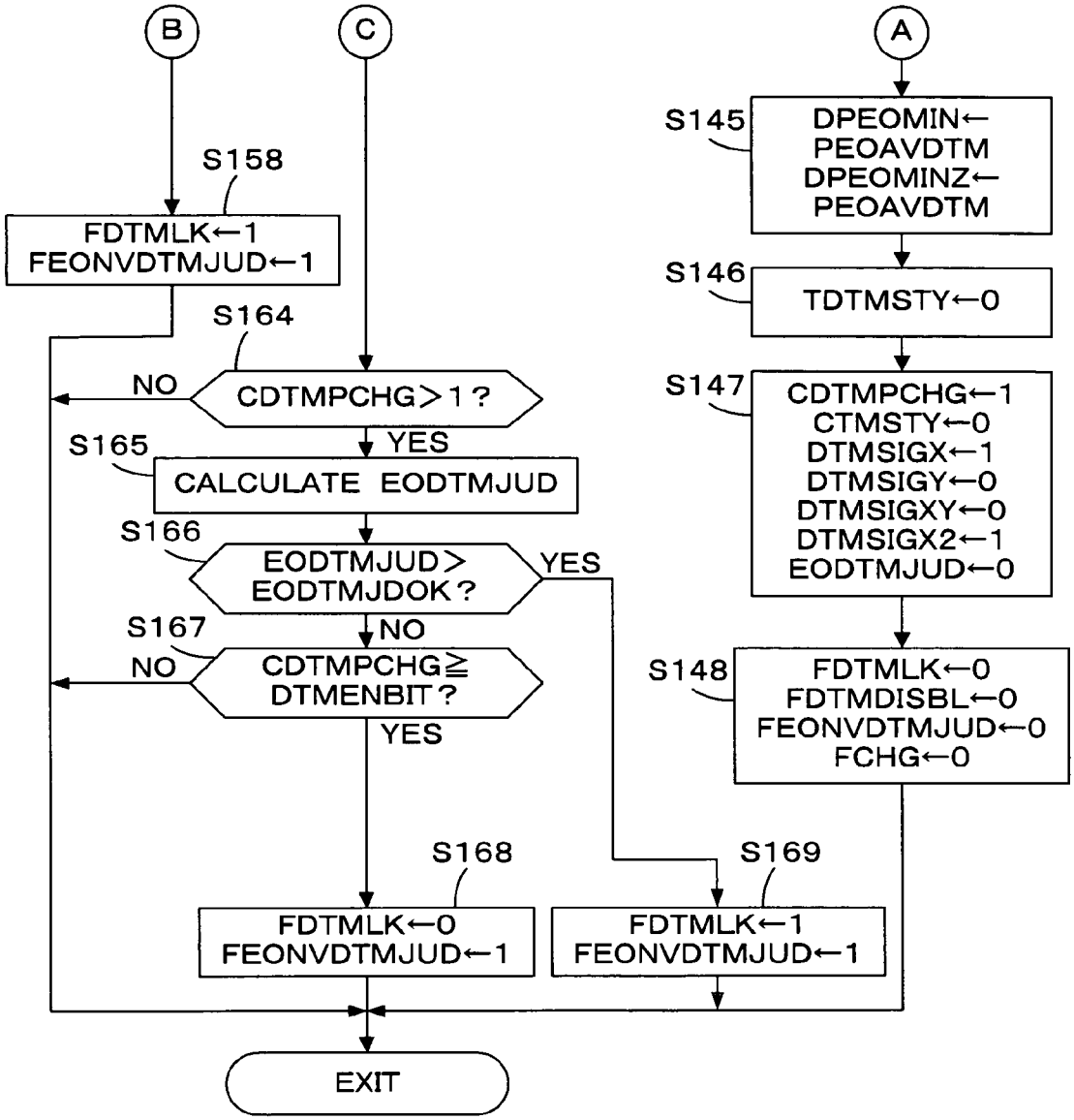

FIGS. 17 and 18 are flowcharts of a process for executing the second leak determination. This process is executed at predetermined time intervals (for example, 1 second) by the CPU in the ECU 5.

In step S141, it is determined whether the VSV closing flag FVSVCPTCL is "1". If FVSVCPTCL is equal to "0", indicating that the open-to-atmosphere process is being executed, then the process advances to step S145 (FIG. 18), in which the minimum pressure DPEOMIN and the preceding value DPEOMINZ of the minimum pressure DPEOMIN are both set to the present staying tank pressure parameter PEOAVDTM. In step S146, the value of an upcount timer TDTMSTY for measuring the staying time period of the staying tank pressure parameter PEOAVDTM is set to "0".

In step S147, initialization of parameters to be used for calculation of a second inclination parameter EODTMJUD, which corresponds to the inclination of the regression lines L11 and L12 shown in FIGS. 9C and 9D, is performed. Specifically, a pressure parameter CDTMPCHG corresponding to the tank pressure PTANK shown in FIGS. 9C and 9D is set to "1"; a staying time period parameter CTMSTY corresponding to the staying time period TSTY shown in FIGS. 9C and 9D is set to "0"; an integrated value DTMSIGX corresponding to the pressure parameter CDTMPCHG is set to "1"; an integrated value DTMSIGY of the staying time period parameter CTMSTY is set to "0"; an integrated value DTMSIGXY of the product of the pressure parameter CDTMPCHG and the staying time period parameter CTMSTY is set to "0"; an integrated value DTMSIGX2 of the value obtained by squaring the pressure parameter CDTMPCHG is set to "1"; and the second inclination parameter EODTMJUD is set to "0".

In step S148, a second leak determination flag FDTMLK, a determination disabling flag FDTMDISBL, a second leak determination end flag FEONVDTMJUD, and a pressure change flag FCHG are all set to "0". The second leak determination flag FDTMLK is set to "1" when there is a small hole leak in the evaporative fuel processing system 40 (refer to steps S158 and S169). The determination disabling flag FDTMDISBL is set to "1" when the determination does not end, even if the maximum execution time period TMEOMAX of the second leak determination elapses (refer to step S143). The second leak determination end flag FEONVDTMJUD is set to "1" when it is determined that the evaporative fuel processing system 40 is normal, or there is a leak in the evaporative fuel processing system 40 (refer to steps S158, S168 and S169). The pressure change flag FCHG is set to "1" when the minimum pressure DPEOMIN has changed (refer to step S159).

If the answer to step S141 is affirmative (YES), indicating that the vent shut valve 38 is closed, it is determined whether the interruption flag FEONVTMUP is "1" (step S142). If the answer to this step is affirmative (YES), then the determination disabling flag FDTMDISBL is set to "1" (step S143), and the process ends.

If FEONVTMUP is equal to "0" in step S142, then the process advances to step S144, in which it is determined whether the second leak determination condition flag FEODTMEX is "1". If the answer to this step is negative (NO), then the process advances to step S145. In other words, the second leak determination is not performed.

After the second leak determination condition flag FEODTMEX is set to "1", the process advances from step S144 to step S149, in which the preceding value DPEOMINZ of the minimum pressure is set to the present value DPEOMIN. In step S150, the lower one of the minimum pressure DPEOMIN and the staying tank pressure parameter PEOAVDTM is selected and the minimum pressure DPEOMIN is calculated by the following expression (18).

$$DPEOMIN=MIN(DPEOMIN, PEOAVDTM) \quad (18)$$

In step S151, it is determined whether the present value DPEOMIN of the minimum pressure is equal to the preceding value DPEOMINZ. If the answer to this step is affirmative (YES), then it is determined whether the value of the timer TDTMSTY is equal to or greater than a predetermined determination time period TDTMLK (for example, 5 seconds) (step S152). Since the answer to this step is initially negative (NO), the process advances to step S153 in which the staying time period parameter CTMSTY is incremented by "1". Next, it is determined whether the pressure change flag FCHG is "1" (step S154). Since the answer to this step is initially negative (NO), the process immediately advances to step S164 (FIG. 18).

If the minimum pressure DPEOMIN changes, i.e., the staying tank pressure parameter PEOAVDTM decreases, then the process advances from step S151 to step S159 in which the pressure change flag FCHG is set to "1". In step S160, the pressure parameter CDTMPCHG is incremented by "1". The pressure parameter CDTMPCHG is a parameter which corresponds to the tank pressure PTANK indicated on the horizontal axis in FIG. 9C or 9D, and increases as the tank pressure PTANK decreases. Accordingly, the second inclination parameter EODTMJUD, calculated by the present process, takes a negative value, corresponding to the straight line L11 shown in FIG. 9C, while the second inclination parameter EODTMJUD takes a positive value, corresponding to the straight line L12 shown in FIG. 9D.

In step S161, the integrated value DTMSIGX of the pressure parameter CDTMPCHG is calculated by the following expression (19).

$$DTMSIGX=DTMSIGX+CDTMPCHG \quad (19)$$

where DTMSIGX on the right side is the preceding calculated value.

In step S162, the integrated value DTMSIGX2 of a value obtained by squaring the pressure parameter CDTMPCHG is calculated by the following expression (20).

$$DTMSIGX2=DTMSIGX2+CDTMPCHG\times CDTMPCHG \quad (20)$$

where DTMSIGX2 on the right side is the preceding calculated value.

In step S163, the value of the timer TDTMSTY is returned to "0". Thereafter, the process advances to step S164.

After the pressure change flag FCHG is set to "1", the answer to step S151 becomes affirmative (YES), and the process advances to step S154. Then the answer to step S154 becomes affirmative (YES). Accordingly, the process advances to step S155 in which the integrated value DTMSIGY of the staying time period parameter CTMSTY is calculated by the following expression (21).

$$DTMSIGY=DTMSIGY+CTMSTY \quad (21)$$

where DTMSIGY on the right side is the preceding calculated value.

In step S156, the integrated value DTMSIGXY of the product of the pressure parameter CDTMPCHG and the staying time period parameter CTMSTY is calculated by the following expression (22).

$$DTMSIGXY=DTMSIGXY+CDTMPCHG\times CTMSTY \quad (22)$$

where DTMSIGXY on the right side is the preceding calculated value.

In step S157, the pressure change flag FCHG is returned to "0" and the staying time period parameter CTMSTY is returned to "0". Thereafter, the process advances to step S164.

In step S164, it is determined whether the pressure parameter CDTMPCHG is greater than "1". If the answer to this step is negative (NO), then the process immediately ends since the inclination of a regression line cannot be calculated. If CDTMPCHG is greater than "1", then the pressure parameter CDTMPCHG, and the integrated values DTMSIGX, DTMSIGX2, DTMSIGY and DTMSIGXY are applied to the following expression (23) to calculate the second inclination parameter EODTMJUD (step S165). In the present embodiment, every time the minimum pressure DPEOMIN changes, the pressure parameter CDTMPCHG is incremented by "1". Therefore, the pressure parameter CDTMPCHG is also a parameter indicative of the number of sampling data. Accordingly, the pressure parameter CDTMPCHG is applied to the expression (23).

$$EODTMJUD = \frac{DTMSIGXY-(DTMSGX\times DTMSIGY)/CDTMPCHG}{DTMSIGX2-DTMSIGX^2/CDTMPCHG} \quad (23)$$

In step S166, it is determined whether the second inclination parameter EODTMJUD is greater than a determination threshold value EODTMJDOK. If the answer to this step is affirmative (YES), then it is determined that there is a leak in the evaporative fuel processing system 40. Accordingly, the second leak determination flag FDTMLK is set to "1" and the second leak determination end flag FEONVDTMJUD is set to "1" (step S169).

When the second inclination parameter EODTMJUD is less than or equal to the determination threshold value EODTMJDOK, then it is determined whether the pressure parameter CDTMPCHG is equal to or greater than a predetermined value DTMENBIT (for example, 10). If CDTMPCHG is less than DTMENBIT, then the process immediately ends. If the pressure parameter CDTMPCHG reaches the predetermined value DTMENBIT, then the process advances to step S168 in which the second leak determination flag FDTMLK is set to "0" and the second leak determination end flag FEONVDTMJUD is set to "1" (step S168).

On the other hand, in step S152, if the value of the timer TDTMSTY for measuring the staying time period is equal to or greater than the predetermined determination time period TDTMLK, then a determination is made that there is a leak in the evaporative fuel processing system 40. Accordingly, the second leak determination flag FDTMLK is set to "1" and the second leak determination end flag FEONVDTMJUD is set to "1" (step S158).

As described above, according to the process of FIGS. 17 and 18, the second leak determination is performed when the staying tank pressure parameter PEOAVDTM is staying or decreasing. When the staying time period TDTMSTY is equal to or longer than the predetermined determination time period TDTMLK, or when the second inclination parameter EODTMJUD, which corresponds to the inclination of the regression line shown in FIG. 9, is greater than the determination threshold value EODTMJDOK, a determination is made that there is a small hole leak in the evaporative fuel processing system 40. That is, a small hole leak, which cannot be detected by the first leak determination (FIGS. 11 and 12), is detected.

Figure 19:
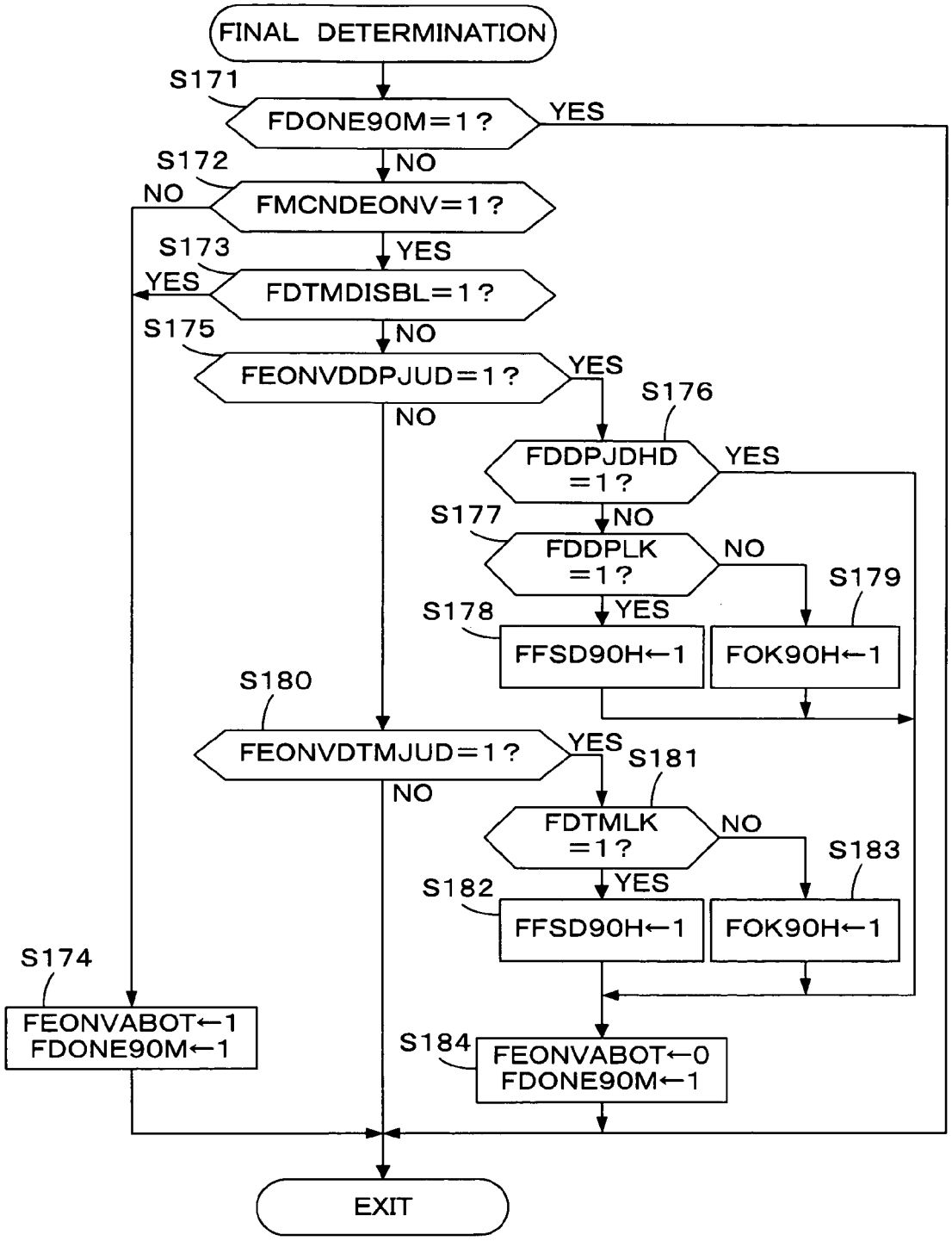
FIG. 19 is a flowchart of a final determination process based on results of the first leak determination and the second leak determination.

FIG. 19 is a flow chart of a process for performing a final determination according to results of the first leak determination process and the second leak determination process. This process is executed at predetermined time intervals (for example, 1 second) by the CPU in the ECU 5.

In step S171, it is determined whether the determination completion flag FDONE90M is "1". If the answer to this step is affirmative (YES), then the process immediately ends. If FDONE90M is equal to "0", then it is determined whether the execution condition flag FMCNDEONV is "1" (step S172). If the answer to this step is affirmative (YES), then it is determined whether the determination disabling flag FDTMDISBL is "1" (step S173). If FMCNDEONV is equal to "0", or FDTMDISBL is equal to "1", then a suspension flag FEONVABOT and the determination completion flag FDONE90M are set to "1" (step S174). Thereafter, the process ends.

If FDTMDISBL is equal to "0" in step S173, then it is determined whether the first leak determination end flag FEONVDDPJUD is "1" (step S175). If FEONVDDPJUD is equal to "1", indicating that the first leak determination is completed, then it is determined whether the withholding flag FDDPJDHD is "1" (step S176). If the withholding flag FDDPJDHD is "1", then the suspension flag FEONVABOT is set to "0" and the determination completion flag FDONE90M is set to "1 " (step S184).

If the withholding flag FDDPJDHD is "0", then the process advances from step S176 to step S177, in which it is determined whether the first leak determination flag FDDPLK is "1". If FDDPLK is equal to "1", then a failure flag FFSD90H is set to "1" (step S178). If FDDPLK is equal to "0", then a normal flag FOK90H is set to "1" (step S179). Thereafter, the process advances to step S184.

If the first leak determination process is not completed, then the process advances from step S175 to step S180, in which it is determined whether the second leak determination end flag FEONVDTMJUD is "1". If the answer to this step is negative (NO), then the process immediately ends. After the second leak determination process is completed, the process advances from step S180 to step S181, in which the second leak determination flag FDTMLK is "1". If FDTMLK is equal to "1", then the failure flag FFSD90H is set to "1" (step S182). If FDTMLK is equal to "0", then the normal flag FOK90H is set to "1" (step S183). Thereafter, the process advances to step S184.

In the present embodiment, the process of FIGS. 11 and 12 corresponds to the first determining means, and the process of FIGS. 14, 17 and 18 corresponds to the second determining means, or simply a determining means.

It is to be noted that the present invention is not limited to the embodiments described above, but various modifications may be made. In the embodiments described above, the pressure sensor 15 is disposed in the charge passage 31. The location of the pressure sensor 15 is not limited to this. Alternatively, the pressure sensor 15 may be disposed, for example, in the fuel tank 9 or the canister 33.

Further, in the second embodiment described above, the tank pressure parameter PEONVAVE and the staying tank pressure parameter PEOAVDTM, obtained by averaging the tank pressure PTANK, are used to perform the leak determination. Alternatively, the tank pressure PTANK itself may be used for the leak determination.

Further, in the process of FIGS. 17 and 18, the least squares method is applied to the pressure parameter CDTMPCHG and the staying time period parameter CTMSTY to calculate the second inclination parameter EODTMJUD. Alternatively, the least squares method may be applied to the tank pressure PTANK and the value of the upcount timer TDTMSTY to calculate the second inclination parameter EODTMJUD.

Further, a negative pressure reservoir, for accumulating the negative pressure (i.e., a pressure lower than the atmospheric air pressure) in the intake pipe 2 while the engine 1 is operating, may be provided. In such case, the negative pressure accumulated in the negative pressure reservoir is introduced into the evaporative fuel processing system 40 after stoppage of the engine 1, and a failure diagnosis for the evaporative fuel processing system 40 is performed based on changes in the tank pressure PTANK after introduction of the negative pressure. In this instance, the first determination method described above can be applied.

Furthermore, the present invention can be applied also to a failure diagnosis for an evaporative fuel processing system, including a fuel tank for supplying fuel to a watercraft propulsion engine such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A failure diagnosis apparatus for diagnosing a failure of an evaporative fuel processing system which includes a fuel tank, a canister having adsorbent for adsorbing evaporative fuel generated in said fuel tank, an air passage connected to said canister wherein said canister communicates with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis apparatus comprising:

pressure detecting means for detecting a pressure in said evaporative fuel processing system;

engine stoppage detecting means for detecting stoppage of said engine; and first determining means for closing said purge control valve and said vent shut valve when stoppage of said engine is detected by said engine stoppage detecting means, and for determining whether there is a leak in said evaporative fuel processing system based on a determination parameter corresponding to a second-order derivative value of the pressure detected by said pressure detecting means during a first predetermined determination period after closing of said purge control valve and said vent shut valve.

2. A failure diagnosis apparatus according to claim 1, further comprising second determining means for determining whether the leak is present in said evaporative fuel processing system based on a relationship between the pressure detected by said pressure detecting means and a staying time period in which the detected pressure stays at a substantially constant value, during a second predetermined determination period which is longer than the first predetermined determination period after closing of said purge control valve and said vent shut valve.

3. A failure diagnosis apparatus according to claim 1, wherein said first determining means determines the leak is present in said evaporative fuel processing system when an absolute value of the determination parameter is greater than a determination threshold value.

4. A failure diagnosis apparatus according to claim 1, wherein said first determining means performs the determination based on the determination parameter obtained during a period in which the detected pressure rises.

5. A failure diagnosis apparatus according to claim 4, wherein said first determining means calculates an average rate of change in the detected pressure during a period in which the detected pressure changes from an initial value to a maximum value, and sets the determination threshold value according to an average rate of change in the detected pressure, said initial value being substantially equal to atmospheric pressure.

6. A failure diagnosis apparatus according to claim 1, wherein said first determining means calculates a change rate parameter indicative of a rate of change in the detected pressure, and uses a rate of change in the change rate parameter as the determination parameter.

7. A failure diagnosis apparatus according to claim 6, wherein said first determining means statistically processes detected values of the change rate parameter and detection timings of the detected values to obtain a regression line indicative of a relationship between the detected value of the change rate parameter and the detection timing, and performs the determination based on an inclination of the regression line.

8. A failure diagnosis apparatus according to claim 2, wherein said second determining means performs the determination based on a relationship between the detected pressure and the staying time period when the detected pressure stays at a substantially constant value or decreases.

9. A failure diagnosis apparatus according to claim 2, wherein said second determining means statistically processes values of the detected pressure and the staying time period to obtain a regression line indicative of a relationship between the detected pressure and the staying time period, and performs the determination based on an inclination of the regression line.

10. A failure diagnosis apparatus according to claim 2, wherein said second determining means determines the leak is present in said evaporative fuel processing system when the staying time period is longer than or equal to a predetermined determination time period.

11. A failure diagnosis apparatus for diagnosing a failure of an evaporative fuel processing system which includes a fuel tank, a canister having adsorbent for adsorbing evaporative fuel generated in said fuel tank, an air passage connected to said canister wherein said canister communicates with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis apparatus comprising:

pressure detecting means for detecting a pressure in said evaporative fuel processing system;

engine stoppage detecting means for detecting stoppage of said engine; and determining means for closing said purge control valve and said vent shut valve when stoppage of said engine is detected by said engine stoppage detecting means, and for determining whether there is a leak in said evaporative fuel processing system based on a relationship between the pressure detected by said pressure detecting means and a staying time period in which the detected pressure stays at a substantially constant value, during a predetermined determination period after closing of said purge control valve and said vent shut valve.

12. A failure diagnosis apparatus according to claim 11, wherein said determining means determines the leak is present in said evaporative fuel processing system, when the staying time period is longer than or equal to a predetermined determination time period.

13. A failure diagnosis method for diagnosing a failure of an evaporative fuel processing system which includes a fuel tank, a canister having adsorbent for adsorbing evaporative fuel generated in said fuel tank, an air passage connected to said canister wherein said canister communicates with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis method comprising the steps of:

a) detecting stoppage of said engine;

b) detecting a pressure in said evaporative fuel processing system;

c) closing said purge control valve and said vent shut valve when stoppage of said engine is detected; and d) determining whether there is a leak in said evaporative fuel processing system based on a determination parameter corresponding to a second-order derivative value of the detected pressure during a first predetermined determination period after closing of said purge control valve and said vent shut valve.

14. A failure diagnosis method according to claim 13, further comprising step:

e) determining whether the leak is present in said evaporative fuel processing system based on a relationship between the detected pressure detected and a staying time period in which the detected pressure stays at a substantially constant value, during a second predetermined determination period which is longer than the first predetermined determination period after closing of said purge control valve and said vent shut valve.

15. A failure diagnosis method according to claim 13, wherein a determination is made as to whether the leak is present in said evaporative fuel processing system when an absolute value of the determination parameter is greater than a determination threshold value.

16. A failure diagnosis method according to claim 13, wherein the determination is performed based on the determination parameter obtained during a period in which the detected pressure rises.

17. A failure diagnosis method according to claim 16, wherein an average rate of change in the detected pressure, during a period in which the detected pressure changes from an initial value to a maximum value, is calculated, and the determination threshold value is set according to the average rate of change in the detected pressure, said initial value being substantially equal to the atmospheric pressure.

18. A failure diagnosis method according to claim 13, wherein a change rate parameter indicative of a rate of change in the detected pressure is calculated, and a rate of change in the change rate parameter is used as the determination parameter.

19. A failure diagnosis method according to claim 18, wherein detected values of the change rate parameter and detection timings of the detected values are statistically processed to obtain a regression line indicative of a relationship between the detected value of the change rate parameter and the detection timing, and the determination is performed based on an inclination of the regression line.

20. A failure diagnosis method according to claim 14, wherein the determination in step e) is performed based on a relationship between the detected pressure and the staying time period when the detected pressure stays at a substantially constant value or decreases.

21. A failure diagnosis method according to claim 14, wherein values of the detected pressure and the staying time period are statistically processed to obtain a regression line indicative of a relationship between the detected pressure and the staying time period, and the determination in step e) is performed based on an inclination of the regression line.

22. A failure diagnosis method according to claim 14, wherein the determination is made in step e) that the leak is present in said evaporative fuel processing system when the staying time period is longer than or equal to a predetermined determination time period.

23. A failure diagnosis method for diagnosing a failure of an evaporative fuel processing system which includes a fuel tank, a canister having adsorbent for adsorbing evaporative fuel generated in said fuel tank, an air passage connected to said canister wherein said canister communicates with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis method comprising the steps of:

a) detecting stoppage of said engine;

b) detecting a pressure in said evaporative fuel processing system;

c) closing said purge control valve and said vent shut valve when stoppage of said engine is detected; and d) determining whether there is a leak in said evaporative fuel processing system based on a relationship between the pressure detected by said pressure detecting means and a staying time period in which the detected pressure stays at a substantially constant value during a predetermined determination period after closing of said purge control valve and said vent shut valve.

24. A failure diagnosis method according to claim 23, wherein the determination is made that the leak is present in said evaporative fuel processing system when the staying time period is longer than or equal to a predetermined determination time period.

25. A computer program encoded on a computer readable-medium for causing a computer to carry out a failure diagnosis method for diagnosing a failure of an evaporative fuel processing system which includes a fuel tank, a canister having adsorbent for adsorbing evaporative fuel generated in said fuel tank, an air passage connected to said canister wherein said canister communicates with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis method comprising the steps of:

a) detecting stoppage of said engine;

b) detecting a pressure in said evaporative fuel processing system;

c) closing said purge control valve and said vent shut valve when stoppage of said engine is detected; and d) determining whether there is a leak in said evaporative fuel processing system based on a determination parameter corresponding to a second-order derivative value of the detected pressure during a first predetermined determination period after closing of said purge control valve and said vent shut valve.

26. A computer program according to claim 25, wherein said failure diagnosis method further comprises step:

e) determining whether the leak is present in said evaporative fuel processing system based on a relationship between the detected pressure detected and a staying time period in which the detected pressure stays at a substantially constant value during a second predetermined determination period which is longer than the first predetermined determination period after closing of said purge control valve and said vent shut valve.

27. A computer program according to claim 25, wherein the determination is made that the leak is present in said evaporative fuel processing system when an absolute value of the determination parameter is greater than a determination threshold value.

28. A computer program according to claim 25, wherein the determination is performed based on the determination parameter obtained during a period in which the detected pressure rises.

29. A computer program according to claim 28, wherein an average rate of change in the detected pressure, during a period in which the detected pressure changes from an initial value to a maximum value, is calculated, and the determination threshold value is set according to the average rate of change in the detected pressure, said initial value being substantially equal to the atmospheric pressure.

30. A computer program according to claim 25, wherein a change rate parameter indicative of a rate of change in the detected pressure is calculated, and a rate of change in the change rate parameter is used as the determination parameter.

31. A computer program according to claim 30, wherein detected values of the change rate parameter and detection timings of the detected values are statistically processed to obtain a regression line indicative of a relationship between the detected value of the change rate parameter and the detection timing, and the determination is performed based on an inclination of the regression line.

32. A computer program according to claim 26, wherein the determination in step e) is performed based on a relationship between the detected pressure and the staying time period when the detected pressure stays at a substantially constant value or decreases.

33. A computer program according to claim 26, wherein values of the detected pressure and the staying time period are statistically processed to obtain a regression line indicative of a relationship between the detected pressure and the staying time period, and the determination in step e) is performed based on an inclination of the regression line.

34. A computer program according to claim 26, wherein the determination is made in step e) that the leak is present in said evaporative fuel processing system when the staying time period is longer than or equal to a predetermined determination time period.

35. A computer program encoded on a computer readable-medium for causing a computer to carry out a failure diagnosis method for diagnosing a failure of an evaporative fuel processing system which includes a fuel tank, a canister having adsorbent for adsorbing evaporative fuel generated in said fuel tank, an air passage connected to said canister wherein said canister communicates with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis method comprising the steps of:

a) detecting stoppage of said engine;

b) detecting a pressure in said evaporative fuel processing system;

c) closing said purge control valve and said vent shut valve when stoppage of said engine is detected; and d) determining whether there is a leak in said evaporative fuel processing system based on a relationship between the pressure detected by said pressure detecting means and a staying time period in which the detected pressure stays at a substantially constant value during a predetermined determination period after closing of said purge control valve and said vent shut valve.

36. A computer program according to claim 35, wherein the determination is made that the leak is present in said evaporative fuel processing system when the staying time period is longer than or equal to a predetermined determination time period.

* * * * *